US011858701B2

(12) United States Patent
Martin et al.

(10) Patent No.: US 11,858,701 B2
(45) Date of Patent: Jan. 2, 2024

(54) CHILD RESISTANT AND SENIOR FRIENDLY CAN LID

(71) Applicant: N2 PACKAGING SYSTEMS, LLC, Kimberly, ID (US)

(72) Inventors: Randy S. Martin, Kimberly, ID (US); Michael G. Standlee, Eden, ID (US); David P. Sibley, Kimberly, ID (US)

(73) Assignee: N2 PACKAGING SYSTEMS, LLC, Kimberly, ID (US)

( * ) Notice: Subject to any disclaimer, the term of this patent is extended or adjusted under 35 U.S.C. 154(b) by 73 days.

(21) Appl. No.: 17/724,383

(22) Filed: Apr. 19, 2022

(65) Prior Publication Data

US 2022/0234796 A1 Jul. 28, 2022

Related U.S. Application Data

(63) Continuation of application No. 15/616,483, filed on Jun. 7, 2017, now abandoned.

(Continued)

(51) Int. Cl.

*B65D 50/06* (2006.01)
*B65D 55/02* (2006.01)

(Continued)

(52) U.S. Cl.

CPC ..... *B65D 50/061* (2013.01); *B65D 43/0212* (2013.01); *B65D 53/06* (2013.01);

(Continued)

(58) Field of Classification Search

CPC .. B65D 50/061; B65D 43/0212; B65D 53/06; B65D 55/02; B65D 2543/00537;

(Continued)

(56) References Cited

U.S. PATENT DOCUMENTS 1,381,831 A 6/1921 Heeren
1,410,515 A 3/1922 Luther (Continued)

FOREIGN PATENT DOCUMENTS

WO WO2014128428 8/2014

OTHER PUBLICATIONS

Ex Parte Quayle Action mailed Oct. 1, 2019 in U.S. Appl. No. 29/659,000, 7 pages.

(Continued)

*Primary Examiner* — James N Smalley
(74) *Attorney, Agent, or Firm* — Perkins Coie LLP

(57) ABSTRACT

The present invention is directed to a can lid that is child resistant, and at the same time senior friendly, and can be initially installed on a can to be removed by an adult, especially a senior adult, and be put back on the can in the same condition where a child could still not be able to easily remove it. The child resistant and senior friendly can lid provided has a replaceable can lid and a locking member, such that when a can is initially opened, it may be readily resealed. The child resistant and senior friendly can lid has tapered, smooth sides to make the lid difficult to grasp and a sealing ledge on the inside surface to grab the seam roll of the upper edge of the can. The lid sealing ledge is relieved in two areas ninety degrees apart leaving a ridge to maintain a seal when the lid is attached to a can. The can lid will be flexible enough to bend for removal by seniors but resistant to removal by children.

13 Claims, 15 Drawing Sheets

Related U.S. Application Data

(60) Provisional application No. 62/347,518, filed on Jun. 8, 2016.

(51) Int. Cl.
*B65D 53/06* (2006.01)
*B65D 43/02* (2006.01)
*B65D 55/08* (2006.01)

(52) U.S. Cl.
CPC ..... *B65D 55/02* (2013.01); *B65D 55/08* (2013.01); *B65D 2215/04* (2013.01); *B65D 2543/0037* (2013.01); *B65D 2543/00092* (2013.01); *B65D 2543/00231* (2013.01); *B65D 2543/00435* (2013.01); *B65D 2543/00537* (2013.01); *B65D 2543/00564* (2013.01); *B65D 2543/00638* (2013.01); *B65D 2543/00685* (2013.01); *B65D 2543/00731* (2013.01); *B65D 2543/00759* (2013.01); *B65D 2543/00796* (2013.01); *B65D 2543/00805* (2013.01)

(58) Field of Classification Search
CPC ..... B65D 2543/00638; B65D 2543/00685; B65D 2543/00759; B65D 2543/00805
See application file for complete search history.

(56) References Cited

U.S. PATENT DOCUMENTS 1,463,856 A 3/1923 Vol Allmen Christian
2,857,083 A 10/1958 Masterson
2,859,786 A 11/1958 Tupper
3,173,574 A 3/1965 Goldsmith
3,281,008 A 10/1966 D'Andrea
3,419,181 A 12/1968 Stec
3,565,295 A 2/1971 Doyle
3,642,161 A 2/1972 Stroud
3,703,975 A 11/1972 Wittemer
3,811,589 A 5/1974 Thornton
3,831,820 A 8/1974 Focht
3,964,634 A 6/1976 Jasinski
4,119,239 A 10/1978 Anderson
4,129,687 A 12/1978 Lahme
RE30,531 E 3/1981 Spector
4,279,353 A * 7/1981 Honma ..... B65D 55/0872 215/254
4,359,166 A * 11/1982 Dubach ..... B65D 45/322 215/272
4,429,800 A 2/1984 Greenspan
4,480,762 A 11/1984 Thomas
4,625,890 A * 12/1986 Galer ..... B65D 45/327 220/795
D292,324 S 10/1987 Decker
4,790,444 A 12/1988 Terzi
4,807,768 A 2/1989 Gach
4,809,874 A 3/1989 Pehr
4,852,757 A 8/1989 Gold
4,883,198 A 11/1989 Manska
D309,109 S 7/1990 Allen
4,960,206 A 10/1990 Johannes
5,011,009 A 4/1991 Scheurer
5,040,691 A 8/1991 Hayes
5,050,621 A 9/1991 Creighton
5,092,477 A 3/1992 Johnson, Jr.
5,135,144 A 8/1992 Blakley
5,137,260 A 8/1992 Pehr
5,292,017 A * 3/1994 Reifers ..... B65D 50/061 215/206
5,310,081 A 5/1994 McCabe
5,402,906 A 4/1995 Brown
5,443,174 A 8/1995 Bauer
D362,389 S 9/1995 Frye
5,449,077 A 9/1995 Seidler
D374,822 S 10/1996 Philips
D385,793 S 11/1997 Marsal
5,779,093 A 7/1998 Poole
5,836,474 A 11/1998 Wessberg
5,866,219 A 2/1999 McClure et al.
D413,485 S 9/1999 Much
D414,650 S 10/1999 Lillelund
5,961,000 A 10/1999 Sanfilippo
5,979,680 A 11/1999 Farside
D421,909 S 3/2000 Opresco
6,053,347 A 4/2000 Fullin
6,152,751 A 11/2000 Hanson
D437,776 S 2/2001 Pullan
6,237,818 B1 5/2001 Kline
6,276,853 B1 8/2001 Breidenbach
D448,995 S 10/2001 McDonald
6,439,409 B1 8/2002 Dressel
6,532,965 B1 3/2003 Abhulimen
6,596,328 B1 7/2003 Bezek et al.
6,793,081 B1 9/2004 Derman
6,874,649 B2 4/2005 Clark
6,923,333 B2 8/2005 Arciniegas
7,040,487 B2 5/2006 Zabka et al.
7,093,710 B2 8/2006 Shimizu
7,111,746 B2 9/2006 Miceli
D540,169 S 4/2007 Tanner
7,231,923 B2 6/2007 Adiga
D585,489 S 1/2009 Han
7,475,787 B2 1/2009 Gruver
7,581,899 B2 9/2009 May
D604,942 S 12/2009 Smith
D610,006 S 2/2010 Ortell
7,798,319 B1 9/2010 Bried
7,845,505 B2 12/2010 Hamamoto
D639,337 S 6/2011 Hung
D639,338 S 6/2011 Hung
D641,628 S 7/2011 Baughman
D653,281 S 1/2012 Shih
D655,605 S 3/2012 Baughman
656,192 A1 3/2012 Chen
D656,545 S 3/2012 Hung
D664,035 S 7/2012 Hu
8,240,492 B2 * 8/2012 Mileti ..... B65D 41/18 215/206
D667,876 S 9/2012 Xie
D669,123 S 10/2012 Jiang
D669,124 S 10/2012 Jiang
8,573,426 B2 5/2013 Maness
D689,735 S 9/2013 Redfern
D698,652 S 2/2014 Sommer
D704,066 S 5/2014 de Lima Paschoal
8,746,240 B2 6/2014 Terry
8,863,947 B2 10/2014 Sibley et al.
D717,104 S 11/2014 Redfern
8,910,640 B2 12/2014 Sears
D721,202 S 1/2015 Liu
D725,310 S 3/2015 Eksouzian
D727,172 S 4/2015 Rosella
D732,733 S 6/2015 Spagnolo
D739,597 S 9/2015 Lavanchy
D739,598 S 9/2015 Lavanchy
9,259,035 B2 2/2016 Terry
9,265,287 B2 2/2016 Sims
D751,902 S 3/2016 Sturk
9,352,288 B2 5/2016 Terry
D770,677 S 11/2016 Van Keppel
D774,887 S 12/2016 Torrison
D775,279 S 12/2016 Shen
D777,034 S 1/2017 Sill
D788,697 S 6/2017 Verleur
9,696,949 B2 7/2017 Hendricks et al.
9,743,691 B2 8/2017 Minskoff
D800,566 S 10/2017 Wieland
D804,306 S 12/2017 Simons
D808,580 S 1/2018 Kwitel
9,878,821 B2 1/2018 Sibley et al.
D812,428 S 3/2018 Wu
9,913,490 B2 3/2018 Clark
9,936,729 B2 4/2018 Garcia
9,950,844 B2 4/2018 Barber

(56) References Cited

U.S. PATENT DOCUMENTS

| | | | |
|---|---|---|---|
| 9,968,127 | B2 | 5/2018 | Han |
| 9,999,250 | B2 | 6/2018 | Minskoff |
| D826,470 | S | 8/2018 | Huang |
| D828,158 | S | 9/2018 | Manis |
| 10,124,941 | B2 | 11/2018 | Sibley et al. |
| D53,092 | S | 3/2019 | Swanson |
| D859,143 | S | 9/2019 | Perdue |
| 861,979 | A1 | 10/2019 | Sibley |
| D865,439 | S | 11/2019 | Matsumoto |
| 10,463,075 | B2 | 11/2019 | Beardsall |
| D876,232 | S | 2/2020 | Sibley |
| 10,597,205 | B2 | 3/2020 | Sibley |
| D891,175 | S | 7/2020 | Martin |
| 10,954,042 | B2 | 3/2021 | French |
| 2002/0148833 | A1 | 10/2002 | Simon |
| 2002/0169635 | A1 | 11/2002 | Shillinburg |
| 2005/0092751 | A1 | 5/2005 | Alvares |
| 2005/0145627 | A1 | 7/2005 | Stull |
| 2005/0173272 | A1 | 8/2005 | Lemmons |
| 2006/0060578 | A1 | 3/2006 | Church et al. |
| 2006/0144726 | A1 | 6/2006 | Foust |
| 2006/0231447 | A1 | 10/2006 | Fensham |
| 2007/0034595 | A1 | 2/2007 | Foster |
| 2008/0052044 | A1 | 2/2008 | Shoenfeld |
| 2008/0149584 | A1 | 6/2008 | Martinelli |
| 2008/0202956 | A1 | 8/2008 | Welk |
| 2008/0283527 | A1 | 11/2008 | Allen |
| 2008/0314916 | A1 | 12/2008 | Dimartino |
| 2009/0212004 | A1 | 8/2009 | Metzger et al. |
| 2009/0266736 | A1 | 10/2009 | Sprishen et al. |
| 2009/0314299 | A1 | 12/2009 | Kilpatrick |
| 2010/0031968 | A1 | 2/2010 | Sheikh |
| 2010/0083959 | A1 | 4/2010 | Siller |
| 2010/0101186 | A1 | 4/2010 | Cronin |
| 2010/0175639 | A1 | 7/2010 | Sibley |
| 2010/0307113 | A1 | 12/2010 | Bried et al. |
| 2011/0023895 | A1 | 2/2011 | Wang |
| 2011/0174639 | A1 | 7/2011 | Sibley et al. |
| 2011/0277764 | A1 | 11/2011 | Terry |
| 2011/0303566 | A1 | 12/2011 | Gibson |
| 2011/0308986 | A1 | 12/2011 | Lee |
| 2012/0037654 | A1 | 2/2012 | McNamara |
| 2012/0064468 | A1 | 3/2012 | Sibley et al. |
| 2012/0318283 | A1 | 12/2012 | Watanabe |
| 2012/0318882 | A1 | 12/2012 | Abehasera |
| 2013/0015215 | A1 | 1/2013 | Coote |
| 2013/0105482 | A1 | 5/2013 | Letica, II |
| 2013/0008809 | A1 | 10/2013 | Cortez |
| 2014/0096781 | A1 | 4/2014 | Sears |
| 2014/0283858 | A1 | 9/2014 | Liu |
| 2014/0283859 | A1 | 9/2014 | Minskoff |
| 2015/0034104 | A1 | 2/2015 | Zhou |
| 2015/0048169 | A1 | 2/2015 | Doberschutz |
| 2015/0136618 | A1 | 5/2015 | Patel |
| 2015/0253055 | A1 | 9/2015 | Tsui |
| 2015/0290699 | A1 | 10/2015 | Claydon |
| 2015/0320114 | A1 | 11/2015 | Wu |
| 2015/0374036 | A1 | 12/2015 | Suzuki |
| 2016/0016700 | A1 | 1/2016 | Stevens |
| 2016/0016715 | A1 | 1/2016 | Crawford et al. |
| 2016/0031627 | A1 | 2/2016 | Yeh |
| 2016/0046415 | A1 | 2/2016 | Buck |
| 2016/0167845 | A1 | 6/2016 | Harvey |
| 2016/0273789 | A1 | 9/2016 | Gwen |
| 2016/0331912 | A1 | 11/2016 | Trzecieski |
| 2016/0360782 | A1 | 12/2016 | Barrantes |
| 2017/0215478 | A1 | 8/2017 | Harrison |
| 2017/0253408 | A1 | 9/2017 | Strassburger |
| 2017/0258142 | A1 | 9/2017 | Hatton |
| 2017/0305615 | A1 | 10/2017 | Witt |
| 2017/0355495 | A1 | 12/2017 | Martin et al. |
| 2018/0042302 | A1 | 2/2018 | Robinson |
| 2018/0098571 | A1 | 4/2018 | Watson |
| 2018/0117268 | A1 | 5/2018 | Selby |
| 2018/0153221 | A1 | 6/2018 | Verleur |
| 2018/0177234 | A1 | 6/2018 | Lee |
| 2018/0319556 | A1 | 11/2018 | Straughan |
| 2019/0276202 | A1 | 9/2019 | Wilson |
| 2019/0315532 | A1 | 10/2019 | Boggs |
| 2020/0140156 | A1 | 5/2020 | Combs |
| 2021/0102829 | A1* | 4/2021 | Woolery ..... B65D 41/26 |
| 2021/0114783 | A1 | 4/2021 | Sibley et al. |
| 2021/0122539 | A1 | 4/2021 | Martin et al. |

OTHER PUBLICATIONS

Examination report No. 1 dated Feb. 7, 2018 in Australian Patent Application No. 2015339764, 6 pages.
Final Office Action dated Dec. 9, 2019 in U.S. Appl. No. 16/186,880, 5 pages.
Final Office Action dated Jun. 13, 2014 in U.S. Appl. No. 13/233,931, 10 pages .
Final Office Action dated Mar. 4, 2022 in U.S. Appl. No. 15/616,483, 13 pages.
International Search Report and Written Opinion dated Aug. 24, 2018 in International Application No. PCT/US18/33561, 11 pages.
International Search Report and Written Opinion dated Feb. 3, 2020 in International Application No. PCT/US19/60661, 7 pages.
International Search Report and Written Opinion dated Jan. 8, 2016 in International Application No. PCT/US15/56158, 9 pages.
Non-Final Office Action dated Apr. 6, 2020 in U.S. Appl. No. 29/667,732, 11 pages.
Non-Final Office Action dated Feb. 9, 2017 in U.S. Appl. No. 14/519,031, 8 pages.
Non-Final Office Action dated Oct. 8, 2013 in U.S. Appl. No. 13/233,931, 10 pages.
Non-Final Office Action dated Sep. 12, 2017 in U.S. Appl. No. 14/519,031, 7 pages.
Non-Final Office Action dated Sep. 18, 2019 in U.S. Appl. No. 16/186,880, 7 pages.
Non-Final Office Action dated Sep. 4, 2018 in U.S. Appl. No. 29/621,608, 10 pages.
Notice of Allowance dated Aug. 21, 2014 in U.S. Appl. No. 13/233,931, 810 pages.
Notice of Allowance dated Dec. 18, 2019 in U.S. Appl. No. 29/659,000, 3 pages.
Notice of Allowance dated Jan. 27, 2020 in U.S. Appl. No. 16/186,880, 5 pages.
Notice of Allowance dated Jun. 1, 2020 in U.S. Appl. No. 29/667,732, 7 pages.
Notice of Allowance dated May 13, 2019 in U.S. Appl. No. 29/621,608, 3 pages.
Notice of Allowance dated Nov. 21, 2017 in U.S. Appl. No. 14/519,031, 8 pages.
Notice of Allowance dated Sep. 18, 2018 in U.S. Appl. No. 15/882,962, 6 pages.
Office Action dated Jan. 13, 2020 in European Patent Application No. 15854441.1, 3 pages.
Office Action dated Jan. 17, 2022 in Colombian Patent Application No. NC2021/0007365, 19 pages.
Office Action dated Mar. 13, 2019 in European Patent Application No. 15854441.1, 3 pages.
Supplementary European Search Report dated Mar. 23, 2018 in European Patent Application No. 15854441.1, 7 pages.
Supplementary European Search Report dated Jul. 5, 2022 in European Patent Application No. 19885694.0, 8 pages.
You Tube. N2Packagaing Systems LLC, Check the Boxes, May 7, 2019. Available at www.youtube.com/watch?v=b6zqSmkWX51.
International Search Report and Written Opinion dated Sep. 29, 2021 in International Application No. PCT/US21/29627, 15 pages.
Non-Final Office Action dated May 15, 2023 in U.S. Appl. No. 17/140,565, 8 pages.
Non-Final Office Action dated May 8, 2023 in U.S. Appl. No. 17/137,543, 12 pages.
Notice of Allowance dated Sep. 18, 2023 in U.S. Appl. No. 17/140,565, 7 pages.

* cited by examiner

CHILD RESISTANT AND SENIOR FRIENDLY CAN LID

CROSS-REFERENCE TO RELATED APPLICATION(S)

The present application is a continuation of U.S. patent application Ser. No. 15/616,483, titled "CHILD RESISTANT AND SENIOR FRIENDLY CAN LID", filed Jun. 7, 2017, which claims priority to U.S. Provisional Patent Application No. 62/347,518, titled "CHILD RESISTANT AND SENIOR FRIENDLY CAN LID", filed Jun. 8, 2016, the disclosures of which are hereby incorporated by reference in their entireties.

FIELD OF THE INVENTION

This application provides a new and unique can lid for metal cans that will be difficult for children to open but adults, especially senior adults, will have the ability to open the lid and replace it and reseal the container so equipped, readily and easily. More particularly, a child resistant and senior friendly can lid is provided having a replaceable can lid and a locking member.

BACKGROUND OF THE INVENTION

Canning is the process of preserving a product by processing and sealing it in an airtight metal can. Cans are typically either two-piece or three-piece cans. In the case of a two-piece can, a can body is formed by punching a metal plate to form a cylinder closed at one end. The can is then filled and the open end closed by seaming a lid to the can body during the canning process. In the case of a three-piece can, a can body, open at both ends, is formed by rolling and seaming a metal plate. A first end is closed by seaming a lid to the can body. The can is then filled and the second end closed by seaming a lid to the can body during the canning process.

Once these cans are opened with a conventional can opener they are difficult to reseal adequately. In some cases, individuals do not want cans to be opened easily by children where they could be carrying a harmful substance. Thus, there needs to be developed a can lid that is child resistant and can be initially installed on a can to be removed by an adult and then the child resistant lid can be put back on the can in the same condition where a child could still not be able remove it.

Numerous innovations for a Child Resistant Can Lid have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Child Resistant Can Lid and the prior art.

US Patent Application Publication No. 2006/0060578 of John R. Church et al. describes a secure locking container and lid assembly, including a resilient plastic container and lid, are closed by snap-lock engagement of the lid in a locking groove in the interior of the container mouth making it virtually impossible to manually remove the lid without damaging the container assembly or the product therein.

This patent describes a resilient plastic container and lid but does not describe a lid for a can that is difficult for a child to attempt to remove and may be easily removed and securely put back on by an adult.

US Patent Application Publication No. 2015/0290699 of Paul Charles Claydon describes a process for closing a metal can body, suitable for containing an edible product, with a can lid, to provide a metal can suitable for beating in a retort. The process comprises: placing a metal lid over and in contact with an open end of a metal can body; applying an inwardly directed mechanical force to the lid such that at least a central portion of the lid is deformed into the interior space of the metal can body; and seaming the lid to the can body to form an airtight seal between the lid and the can body.

This patent describes a process for closing a metal can body but does not deal with a removable and resealable metal child resistant can lid.

None of these previous efforts, however, provides the benefits attendant with the Child Resistant and Senior Friendly Can Lid. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

SUMMARY OF THE INVENTION

The principle advantage of the preferred embodiment of the Child Resistant and Senior Friendly Can Lid is that they cannot be easily opened in a conventional manner by a child, yet is readily openable by adults, especially senior adults.

Another advantage of the Child Resistant and Senior Friendly Can Lid is that the outer edge is tapered in and smooth and not easy to grip or pry off.

Another advantage of the Child Resistant and Senior Friendly Can Lid is that by weakening the inner surface at one hundred and eighty degrees the material can flex upward to release the lid from the can when pressure is applied.

Another advantage of the Child Resistant and Senior Friendly Can Lid is that when the lid sealing ledge is relieved in the two areas ninety degrees apart, a ridge is left there to maintain the seal when the lid is attached to a can.

Another advantage of the Child Resistant and Senior Friendly Can Lid is that one protrusion on the side of the lid allows a gripping means to push up to open the can lid.

Another advantage is the material is malleable enough to keep it tight on the can and soft enough for adults, especially senior adults, to pull it off, thereby easily opening the resealed can so equipped.

Another advantage is with the first alternate embodiment having relief gripping sections one hundred and eighty degrees apart on the edge of the lid for a tool strap to engage so that the can lid will flex upward to release the lid from the can when pressure is applied.

Another advantage is with a second alternate embodiment is having a plurality of slots one hundred and eighty degrees apart on the edge of the lid so it will flex upward to release the lid from the can when pressure is applied.

Another advantage is with a third alternate embodiment is the Child Resistant and Senior Friendly Can Lid will have relief gripping locations one hundred and eighty degrees apart on the edge of the lid.

Another advantage is with a fourth alternate embodiment is the Child Resistant and Senior Friendly Can Lid will have a plurality of slots one hundred and eighty degrees apart on the edge of the lid so it will flex upward.

Another advantage is with a fifth alternate embodiment of the Child Resistant and Senior Friendly Can Lid will have a securing unit to lock the can locking member in place.

Another advantage is with a sixth alternate embodiment of the Child Resistant and Senior Friendly Can Lid will have a rubber sealant coating applied to the lid inner surface, with the vacuum sealing can locking member having the rubber sealant applied on the inner surface.

Another advantage is with a seventh alternate embodiment of the Child Resistant and Senior Friendly Can Lid will incorporate a threaded attachment between the lid and the vacuum sealable can locking member.

The preferred embodiment of the Child Resistant and Senior Friendly Can Lid will be comprised of two parts, a lid and a can locking member. The locking inner member has an external locking trough around the circumference with a narrow relief area. The lid has a mating locking inner portion that engages within the trough in the can locking member with a locking nib that when located next to the relief area in the can be pressed upward to remove the lid. An upper portion of an arrow shaped indicator is located on the can lid and a lower portion of the arrow shaped indicator is located on the can locking member.

The lid can be rotated so that the locking nib does not align with the relief area and the can will remain locked until the lid is again rotated until the two parts of the arrow shaped indicator section come together. Preferably, fourteen (14) restraining teeth on the inner lower edge of the can locking member will be forced over and will engage under the can lip to lock the Child Resistant and Senior Friendly Can Lid to the can. The number of retaining teeth can be varied from 14 to 25 teeth.

The preferred embodiment of the Child Resistant and Senior Friendly Can Lid will have tapered, smooth sides to make the lid hard to grasp and a sealing ledge on the cap inside surface to grab the seam roll of the upper edge of the can. The lid sealing ledge is relieved in two areas ninety degrees apart leaving a ridge to maintain a seal when the lid is attached to a can. The lid will flex when it is pushed up where the indicia "PUSH UP" and the lifting protrusion are located with a small tab located below to make it easier for adults to remove the cap.

The first alternate embodiment of the Child Resistant and Senior Friendly Can Lid will be comprised of three parts, the lid, the can locking member and the securing unit. The lid has a mating locking inner portion that engages within the trough in the can locking member with a locking nib that when located next to the relief area in the can be pressed upward to remove the lid. The securing unit has fourteen wedge shaped teeth that are pressed between the can locking member and the lid of the can to further secure Child Resistant Can and Senior Friendly Lid to the can.

The second alternate embodiment of the Child Resistant and Senior Friendly Can Lid will be comprised of three parts, the lid, the can locking member and the securing unit. The fourteen restraining teeth on the inner lower edge of the can locking member have a thinner cross section and are longer and more flexible so that they fully bend up under lip to lock the Child Resistant and Senior Friendly Can Lid to the can.

The third alternate embodiment of the Child Resistant and Senior Friendly Can Lid will have relief gripping locations one hundred and eighty degrees apart on the edge of the lid for a strap tool to engage on either side of the outer perimeter so that the can lid will flex upward to release the lid from the can when an upward pressure is applied on the strap tool and a downward pressure is applied by the thumb against the lid.

The fourth alternate embodiment of the Child Resistant and Senior Friendly Can Lid will have a plurality of slots one hundred and eighty degrees apart on the edge of the lid so it will flex upward to release the lid from the can when an upward pressure is applied on the strap tool and a downward pressure is applied by the thumb against the lid.

The fifth alternate embodiment of the Child Resistant and Senior Friendly Can Lid will have a securing unit to lock the can locking member in place.

The sixth alternate embodiment of the Child Resistant and Senior Friendly Can Lid will have a rubber sealant coating applied to the lid inner surface, with the vacuum sealing can locking member having the rubber sealant applied on the inner surface of the edge.

The seventh alternate embodiment of the Child Resistant and Senior Friendly Can Lid will incorporate a threaded attachment between the lid and the Vacuum sealing can locking member. The vacuum sealing can locking member puts pressure on the rubber sealing coating on the side and top of the can rim when the restraining teeth are locked under the can rim. When the lid is tightened down it puts pressure on the rubber sealing coating on the lid and the vacuum sealing can locking member. The lid has a bulbous area on the outer edge with a plurality gripping ribs around the perimeter to aid in tightening down the lid. A second set of gripping ribs are on the perimeter of the Vacuum sealing can locking member helps in tightening the lid. A flexible locking tab is located on one of the gripping ribs to engage with one of the gripping ribs that can be bent upward to release the lid to rotate and open the can. By pressing down on the lid, a partial vacuum will be achieved within the can.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Child Resistant and Senior Friendly Can Lid. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Child Resistant and Senior Friendly Can Lid and together with the description, serve to explain the principles of this application.

FIG. 3 depicts a cross section through the assembled first alternate embodiment of the Child Resistant and Senior Friendly Can Lid, the can locking member with external locking trough and teeth along with wedge teeth on the securing unit, in accordance with the present invention.

For a fuller understanding of the nature and advantages of the Child Resistant and Senior Friendly Can Lid, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
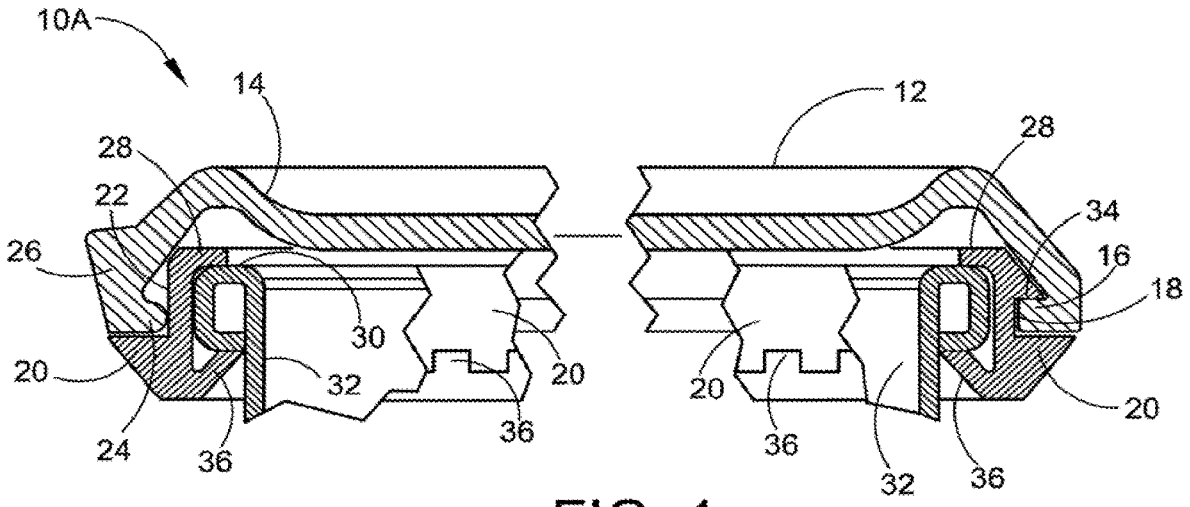
FIG. 1 depicts a cross section of the preferred embodiment of the assembled Child Resistant and Senior Friendly Can Lid over a conventional can, in accordance with the present invention.

Referring now to the drawings, wherein similar parts of the preferred embodiment of the Child Resistant and Senior Friendly Can Lid 10A are identified by like reference numerals, there is seen in FIG. 1 depicting a cross section view of the preferred embodiment of the Child Resistant Can Lid 10A indicating the lid 12 with a contoured surface 14 to secure additional cans for stacking. A locking inner ring 16 of the lid 12 engages within the external locking trough 18 in the circumference of the can locking member 20 with a relief area 22 to access the nib section 24 of the lid 12 for the removal of the lid 12 when an upward pressure is applied at the lifting indicator section 26. The top surface 28 of the can locking member 20 rests on the rim 30 of the can 32 and is held in place by the upper surface 34 of the external locking trough 18. A series of restraining teeth 36 around the lower inner surface can locking member 20 are bent up when the locking member 20 is forced over the top rim 30 of the can 32 to engage under the lip of the can 30.

Figure 2:
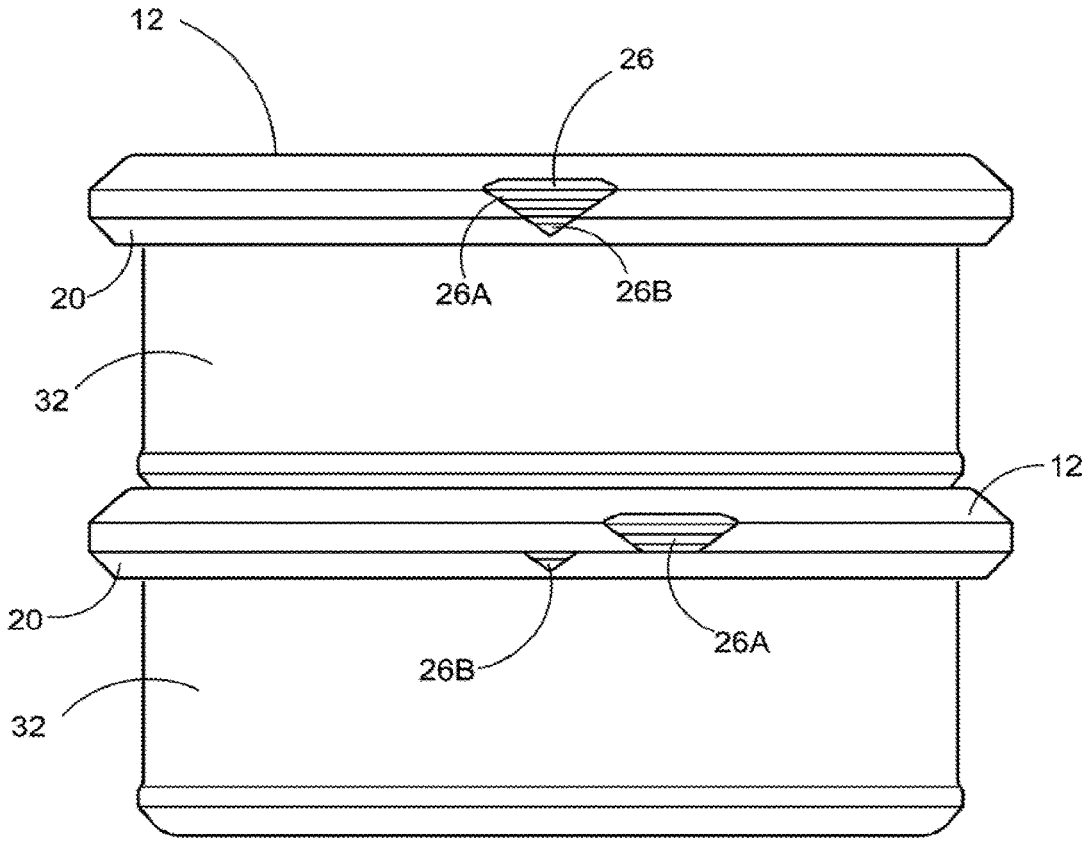
FIG. 2 depicts a side view of two cans with the Child Resistant and Senior Friendly Can Lid stacked one on top of the other having the upper can with the two parts of the indicator section in the can opening position and the lower can with the indicator section separated in the can locked position, in accordance with the present invention.

FIG. 2 depicts a side view of two stacked cans 32 with the lower can 32 having the two sections of the lifting indicator section 26, 26A and 26B together in the opening position. The lower can has the lid 12 rotated so that indicator section 26A is moved to the right putting the lid 12 in the locking position.

Figure 3:
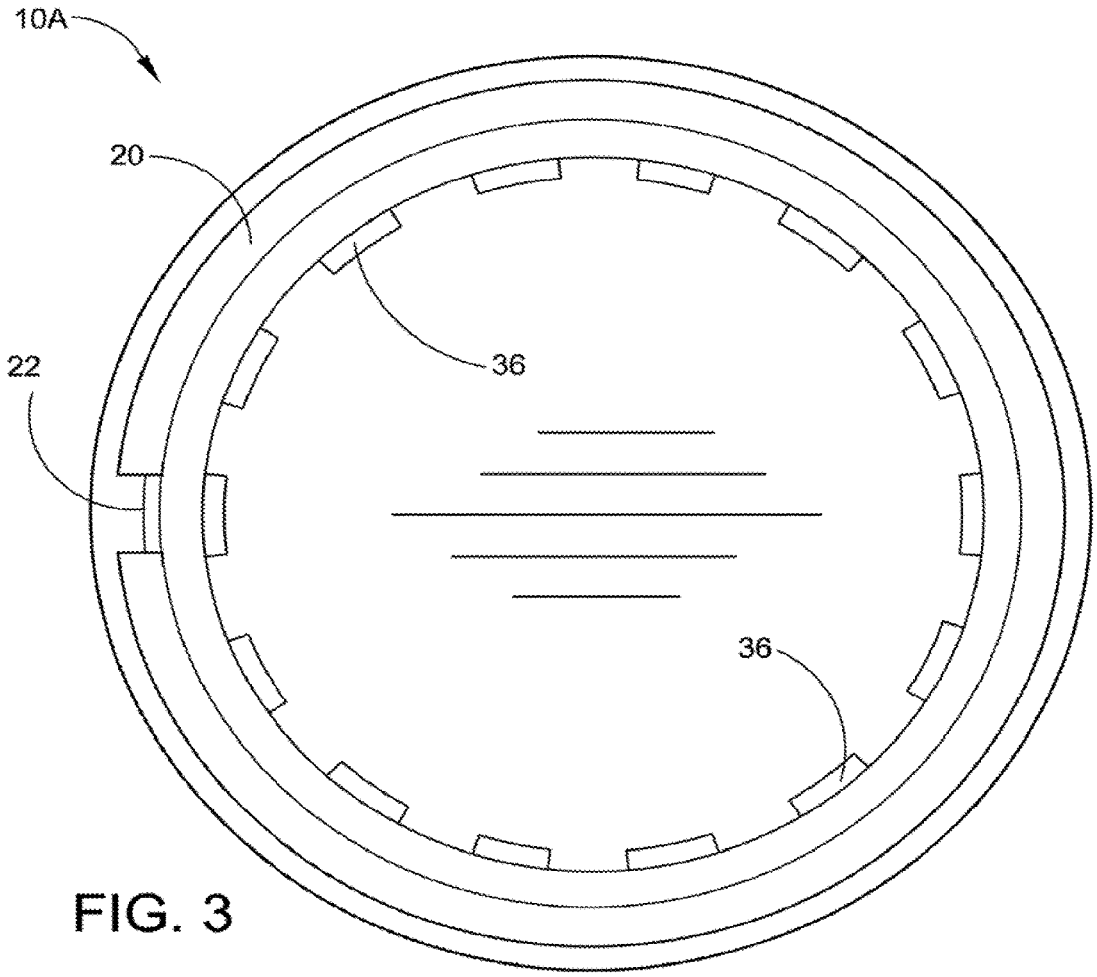
FIG. 3 depicts a top view of the can locking member of the preferred embodiment of the Child Resistant and Senior Friendly Can Lid with restraining teeth, in accordance with the present invention.

FIG. 3 depicts a top view of the can locking member 20 illustrating the 14 restraining teeth 36 and the relief area 22 for the can locking member 20.

Figure 4:
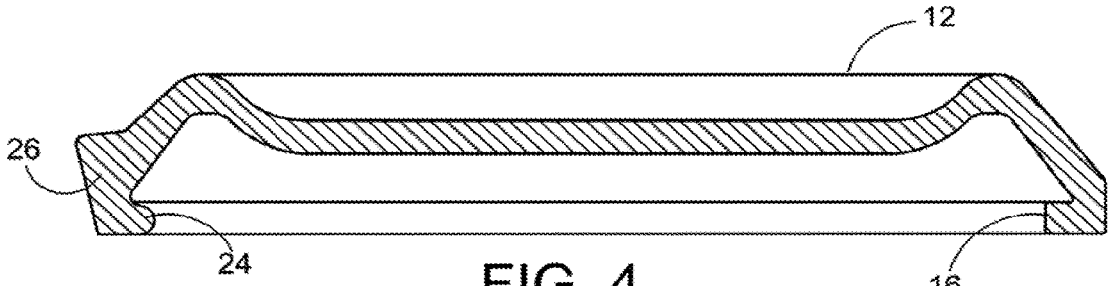
FIG. 4 depicts a cross section through the lid of the preferred embodiment of the Child Resistant and Senior Friendly Can Lid, in accordance with the present invention.

FIG. 4 depicts a cross section of the lid 12 illustrating the location of the nib section 24 and the locking inner ring 16.

Figure 5:
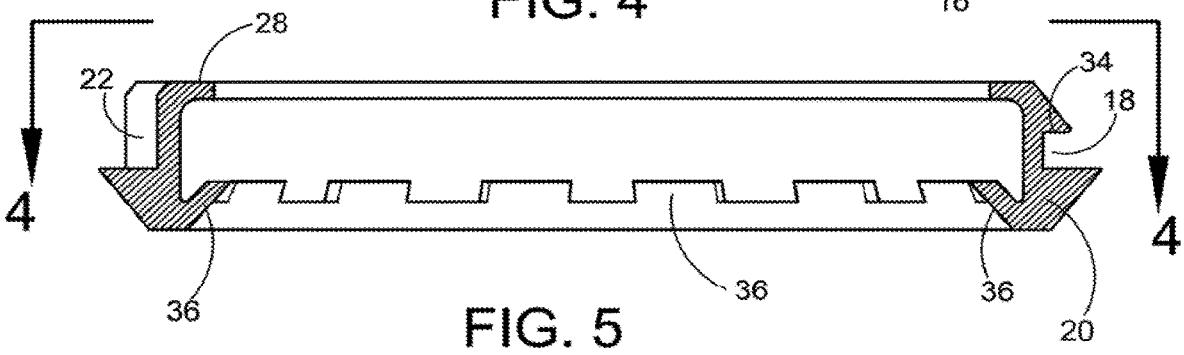
FIG. 5 depicts a cross section through the preferred embodiment of the can locking member with restraining teeth, in accordance with the present invention.

FIG. 5 depicts a cross section of the can locking member 20 illustrating the external locking trough 18 where the locking inner ring 16 is securely held in place. The top surface 28 of the can locking member 20 rests on the rim 30 of the can 32, the 14 restraining teeth 36 are shown on the lower surface with the single relief area 22 for the nib section 24 on the left side.

Figure 6:
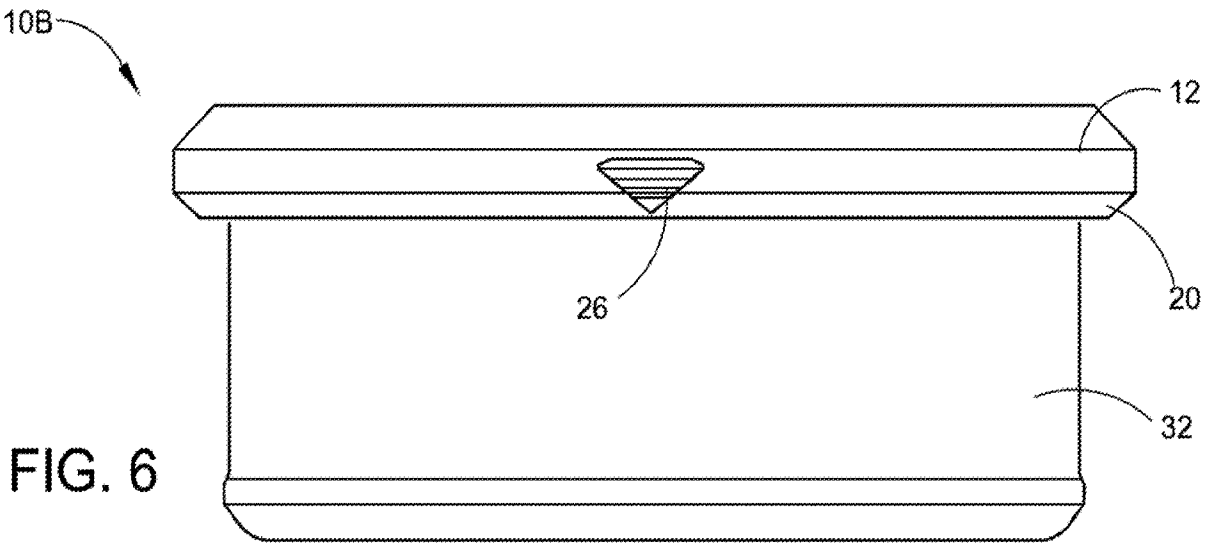
FIG. 6 depicts the first alternate embodiment Child Resistant and Senior Friendly Can Lid illustrating a side view of a conventional can incorporating the Child Resistant and Senior Friendly Can Lid, in accordance with the present invention.

FIG. 6 depicts a side view of a conventional can 32 incorporating the first alternate embodiment of the Child Resistant and Senior Friendly Can Lid 10B.

Figure 7:
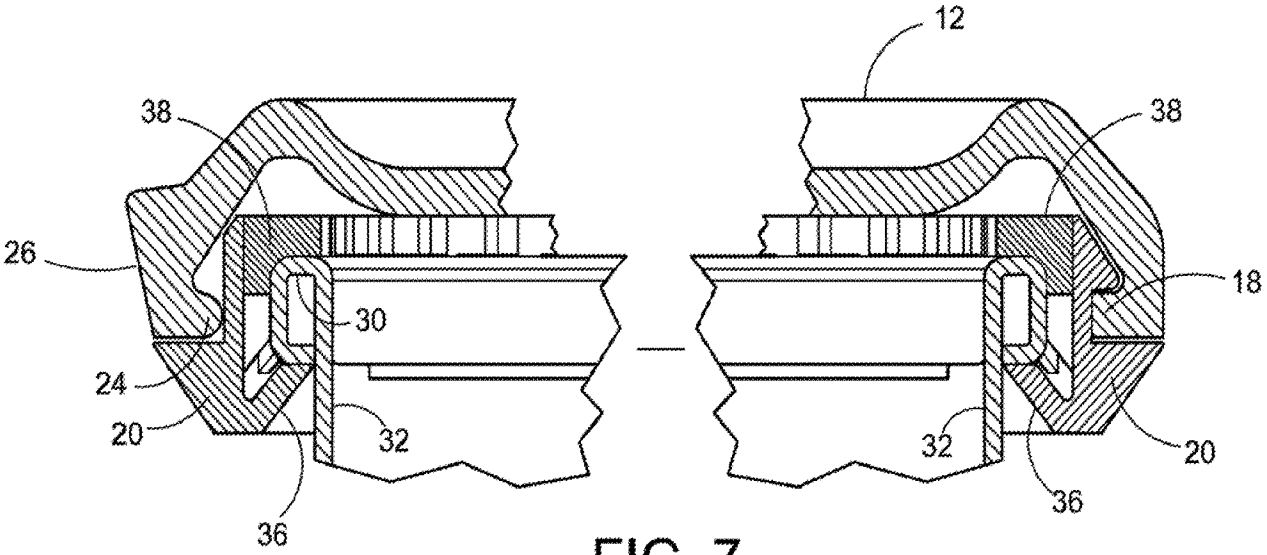
FIG. 7 depicts a cross section through the assembled first alternate embodiment of the Child Resistant and Senior Friendly Can Lid with the conventional can lid with the locking nib section and the can locking member with the addition of a securing unit, in accordance with the present invention.

FIG. 7 depicts a cross section through the assembled first alternate embodiment of the Child Resistant and Senior Friendly Can Lid 10B with the conventional can 32 having a locking nib 24 and the can locking member 20 with the addition of a securing unit 38.

Figure 8:
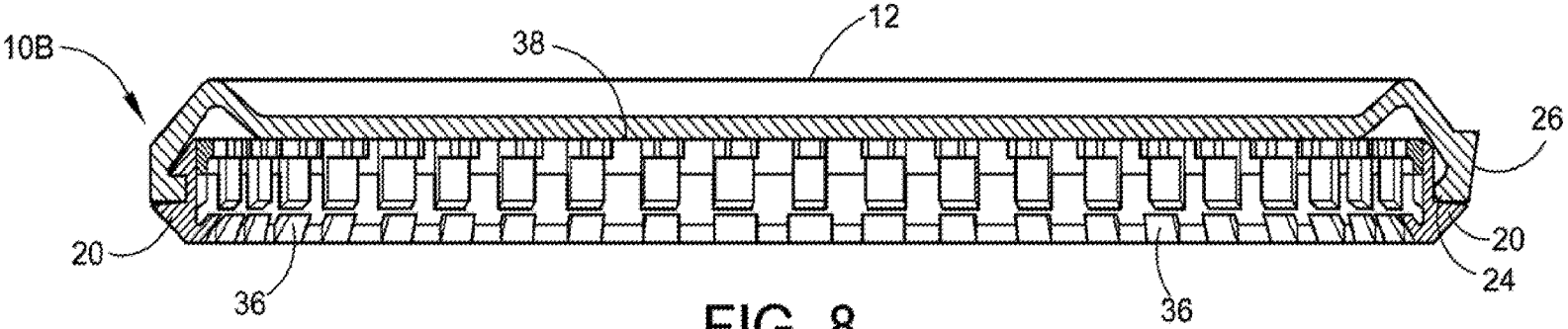

FIG. 8 depicts a cross section through the assembled first alternate embodiment of the Child Resistant and Senior Friendly Can Lid 10B, the can locking member 20 with external locking trough 18 and 24 restraining teeth 36 along with 24 wedge teeth 40 on the securing unit 38.

Figure 9:
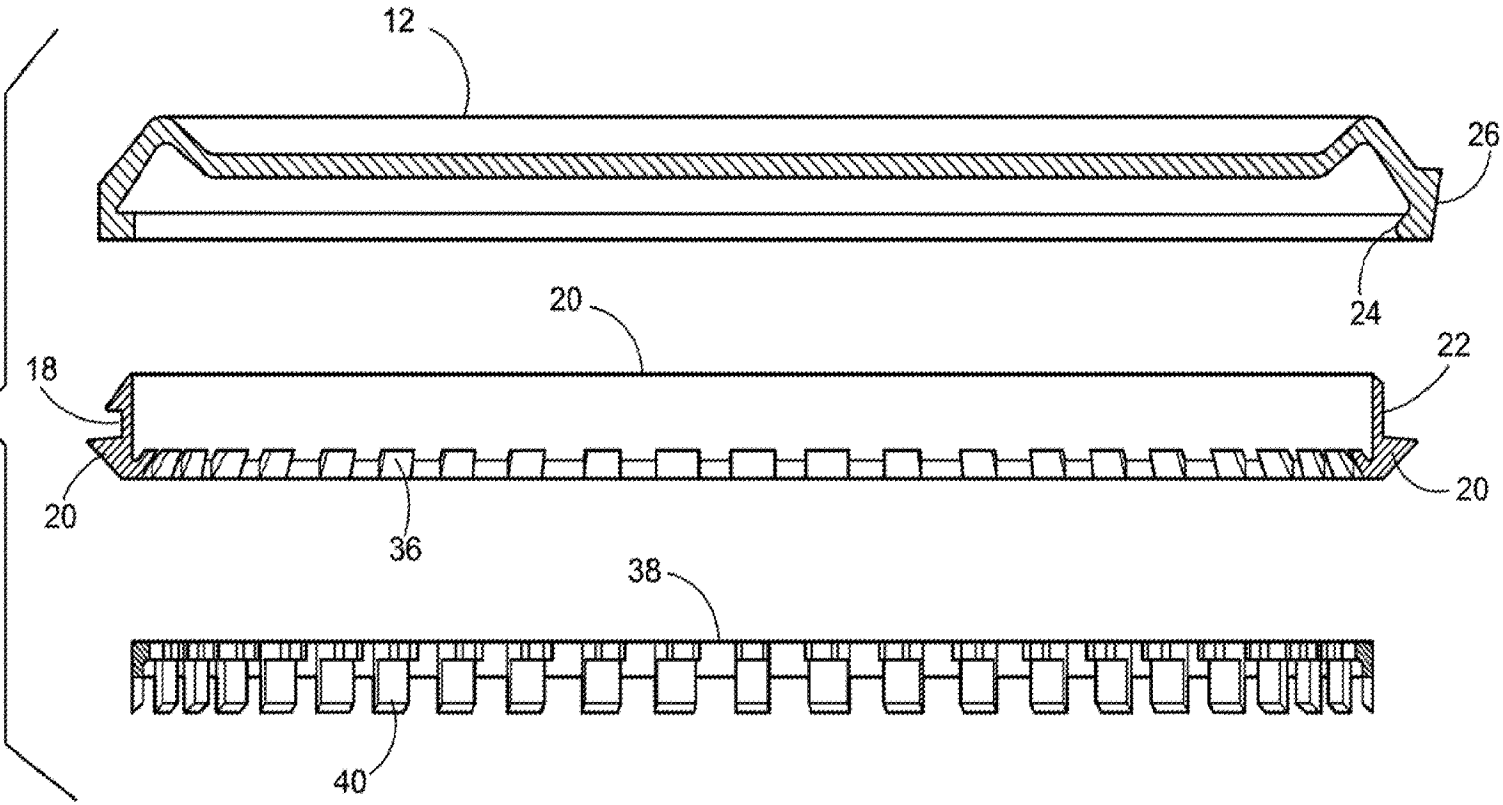
FIG. 9 depicts a cross section through separate first alternate embodiments of the Child Resistant and Senior Friendly Can Lid, the can locking member with teeth and wedge teeth on the securing unit, in accordance with the present invention.

FIG. 9 depicts a cross section through separate first alternate embodiment of the Child Resistant and Senior Friendly Can 10B with the Lid 12 having the can locking member 20 with locking nib 24 restraining teeth 36 and 24 wedge teeth 40 on the securing unit 38.

Figure 10:
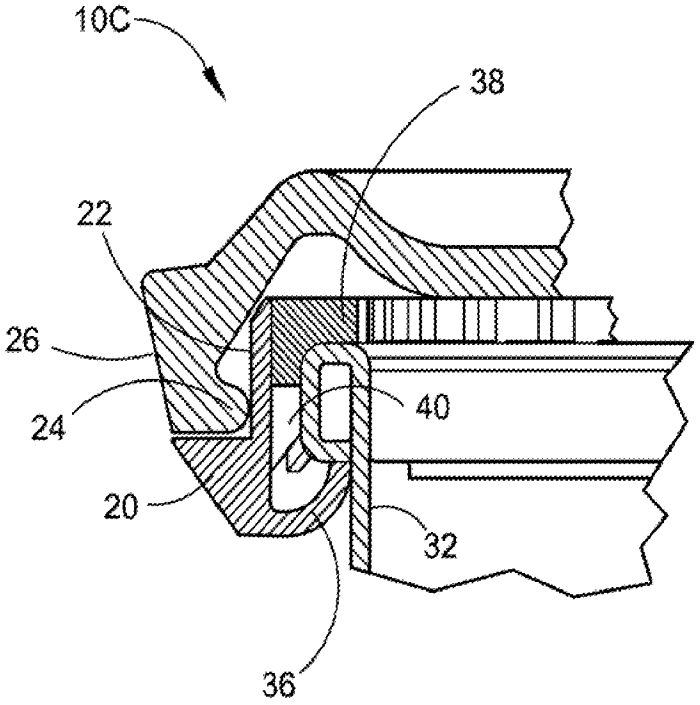
FIG. 10 is a cross section through the assembled second alternate embodiment of the Child Resistant and Senior Friendly Can Lid with a lid, the can locking member with an external locking trough and a relief area for the locking nib. The restraining teeth on the can locking member will have a flexible a configuration, in accordance with the present invention.

FIG. 10 depicts a cross section through the assembled second alternate embodiment of the Child Resistant and Senior Friendly Can Lid 10C with a lid 12, having the can locking member 20 with an external locking trough 18 and a relief area 22 for the locking nib 24. The 24 restraining teeth 36 on the can locking member 20 will have a thinner cross section for a more flexible configuration.

Figure 11:
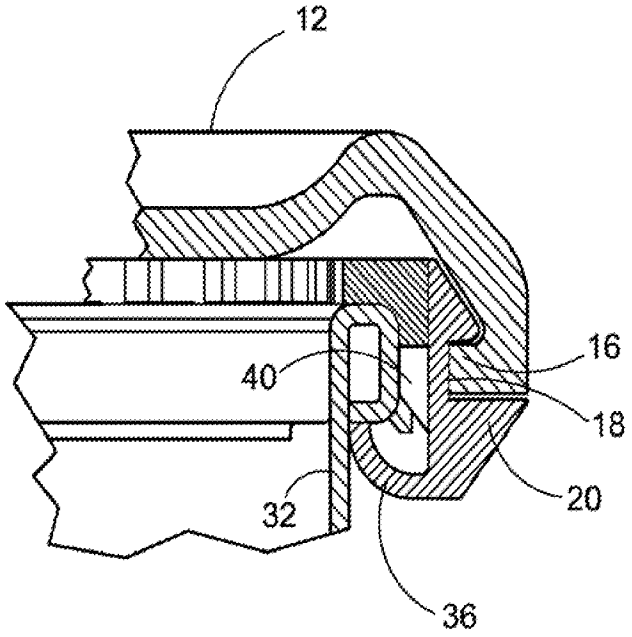
FIG. 11 is a cross section through the assembled second alternate embodiment of the Child Resistant and Senior Friendly Can Lid with a conventional lid with an internal locking inner protrusion, the can locking member with an external locking trough for the locking nib and having a different configuration of the restraining teeth and the securing unit, in accordance with the present invention.

FIG. 11 is a cross section through the assembled second alternate embodiment of the Child Resistant and Senior Friendly Can Lid 10C with a lid 12, and the can locking member 20 with an external locking trough 18 for the locking nib 24 and having the different configuration of the restraining teeth 36.

Figure 12:
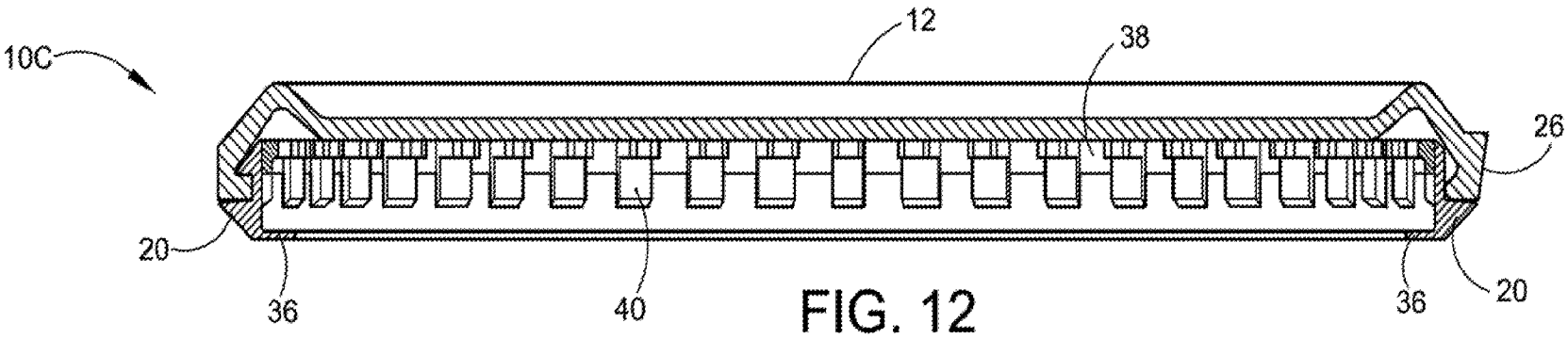
FIG. 12 is a cross section of the assembled second alternate embodiment of the Child Resistant and Senior Friendly Can Lid with a lid, and the can locking member with the segments of the restraining teeth flat, prior to being bent up when inserted over a conventional can, in accordance with the present invention.

FIG. 12 is a cross section of the assembled second alternate embodiment of the Child Resistant and Senior Friendly Can Lid 10C with a lid 12, and the can locking member 20 with the 24 segments of the restraining teeth 36 flat, prior to being bent up when inserted over a conventional can 32.

Figure 13:
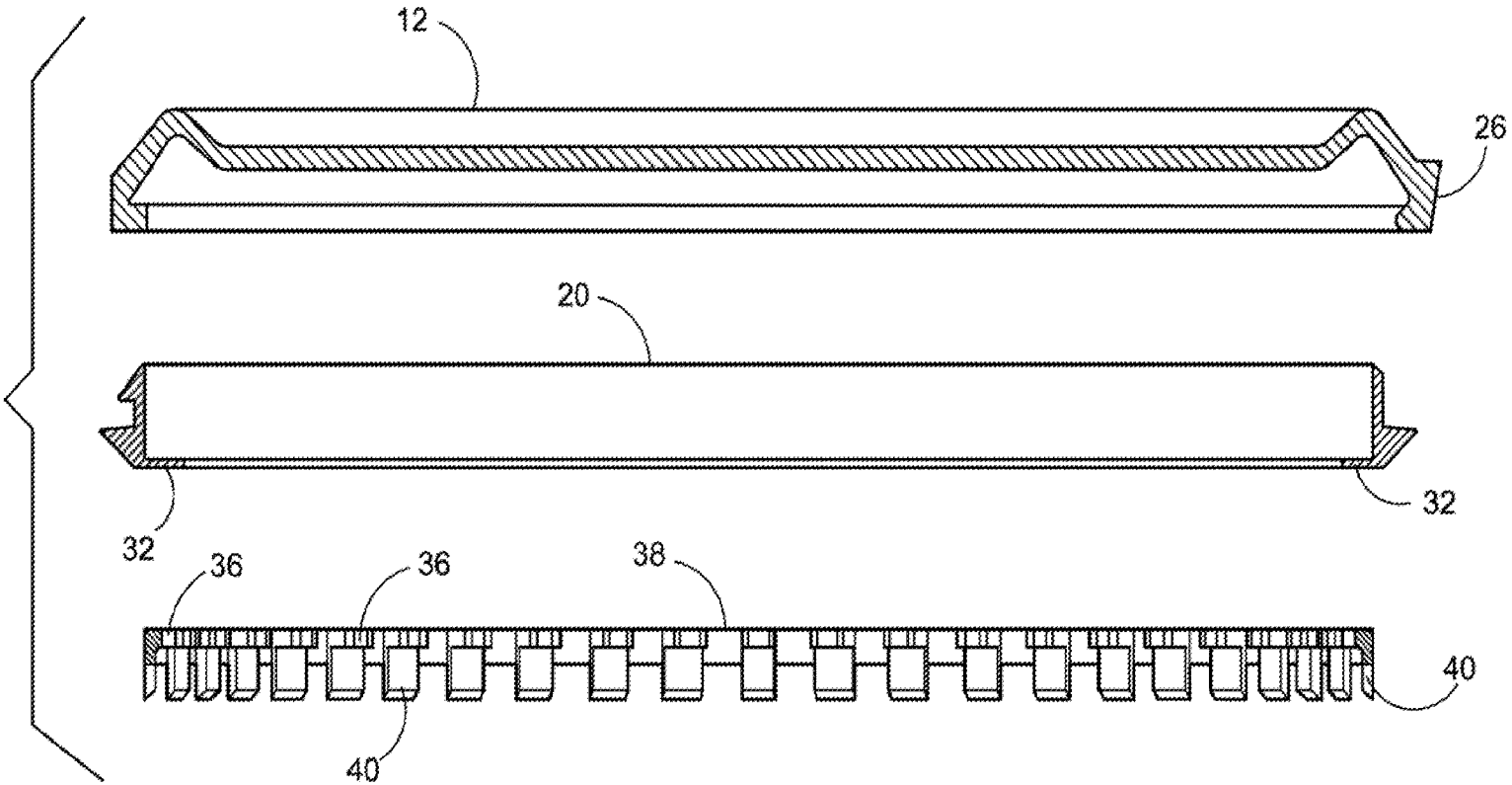
FIG. 13 depicts separate cross sections of the second alternate embodiment of the Child Resistant and Senior Friendly Can Lid illustrating the lid, the can locking member and the securing unit, in accordance with the present invention.

FIG. 13 depicts separate cross sections of the second alternate embodiment of the Child Resistant and Senior Friendly Can Lid 10C illustrating the lid 12, the can locking member 20 and the securing unit 38.

Figure 14:
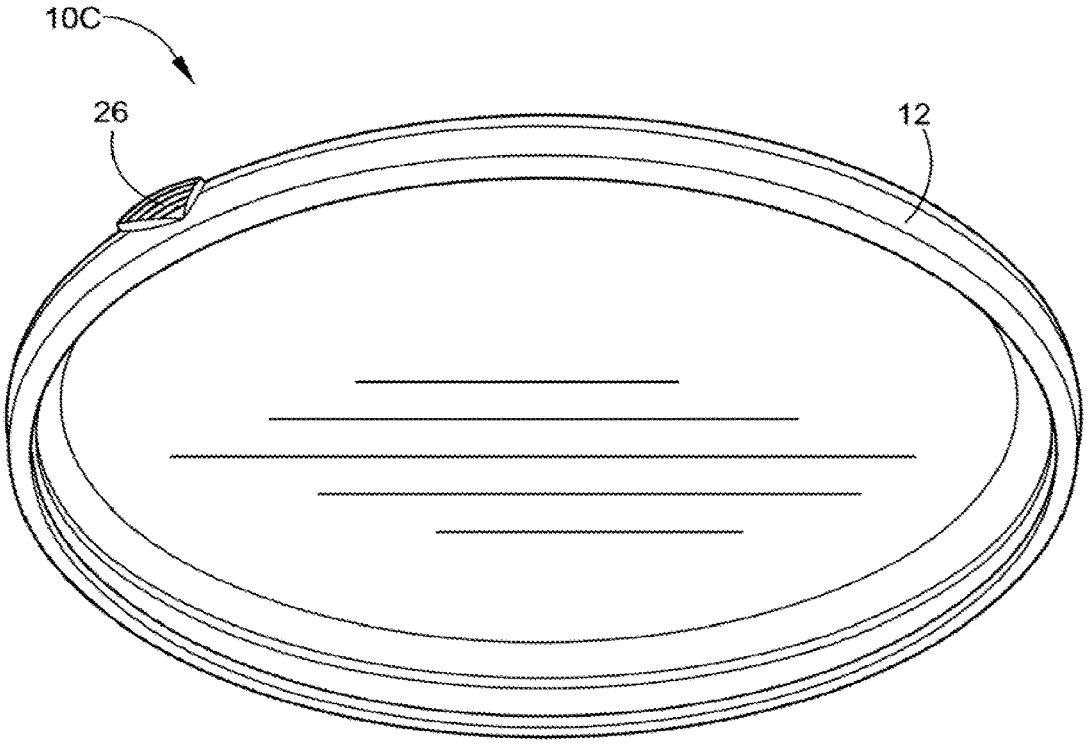
FIG. 14 depicts a perspective bottom view of the lid, in accordance with the present invention.

FIG. 14 depicts a perspective bottom view of the second alternate embodiment of the Child Resistant and Senior Friendly Can Lid 10C, lid 12.

Figure 15:
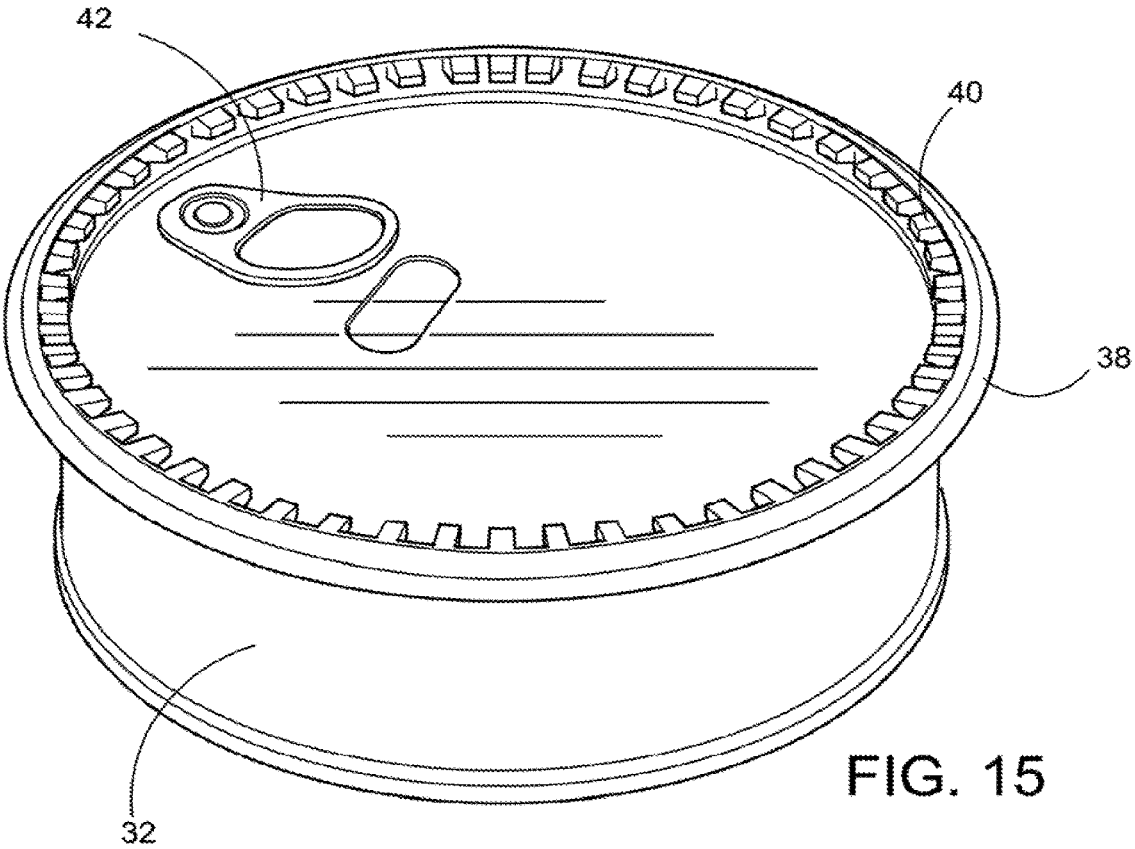
FIG. 15 depicts a perspective view of the top conventional can with pop top opener and the securing unit in place, in accordance with the present invention.

FIG. 15 depicts a perspective view of the top conventional can 32 with an easy open "pop-top" opener 42 and the securing unit 38 in place, having numerous teeth 40.

Figure 16:
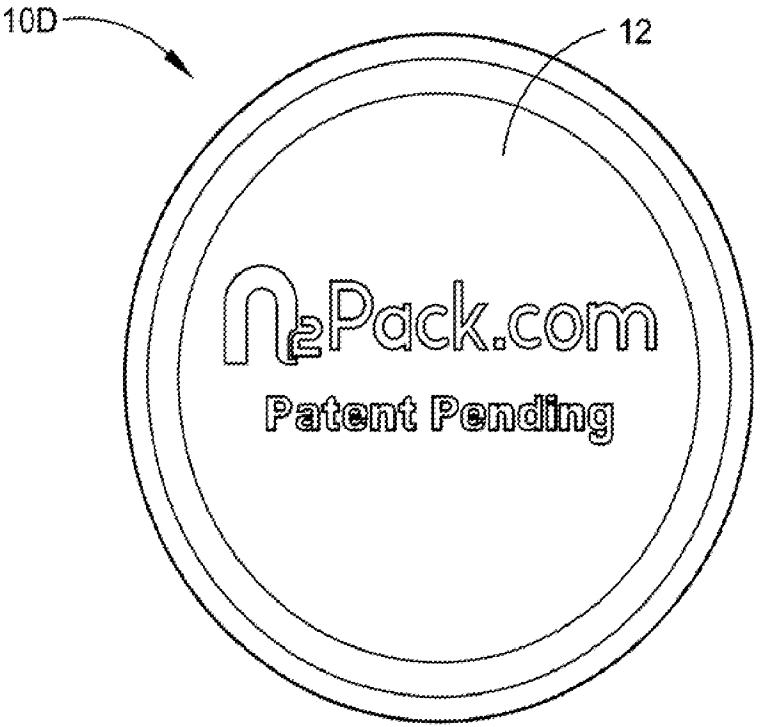
FIG. 16 depicts a top view of the third alternate embodiment Child Resistant and Senior Friendly Can Lid having a flexible lid, in accordance with the present invention.

FIG. 16 depicts a top view of the third alternate embodiment Child Resistant and Senior Friendly Can Lid 10D having a flexible lid 12.

Figure 17:
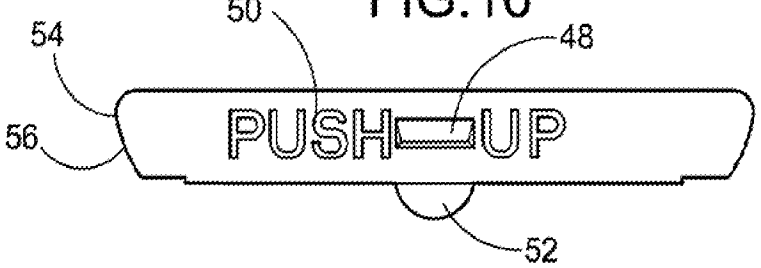
FIG. 17 depicts a side view of the third alternate embodiment Child Resistant and Senior Friendly Can Lid with a flexible lid with the push up indicia and a lifting tab, in accordance with the present invention.

FIG. 17 depicts a side view of the third alternate embodiment of the Child Resistant and Senior Friendly Can Lid 10D depicting the lifting protrusion 48 and the indicia 50 "PUSH UP" and the tab 52 to assist in the removal of the lid 12. The outer perimeter 54 has a smooth angled surface 56 making it difficult to grip by children.

Figure 18:
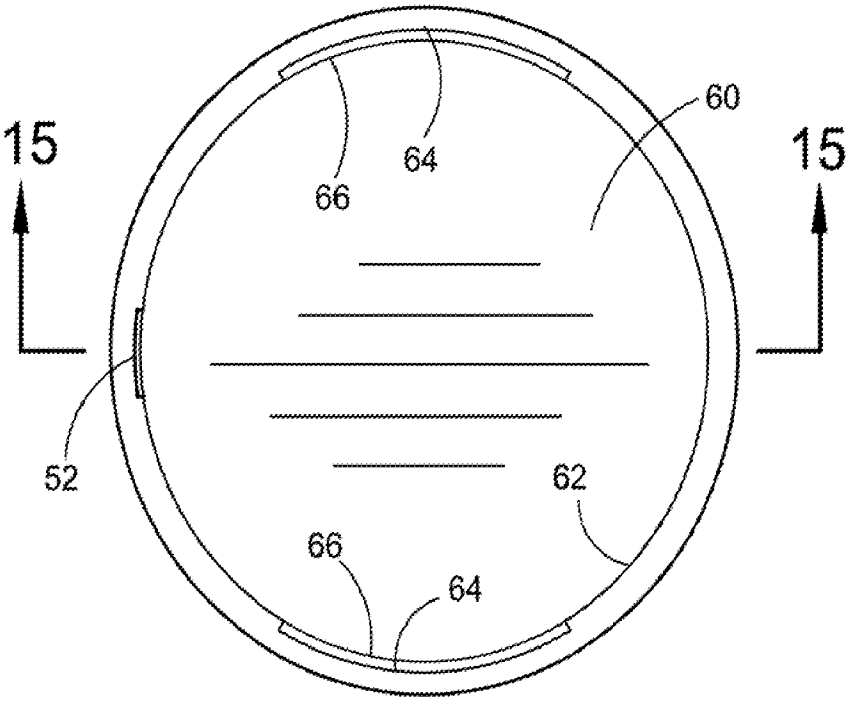
FIG. 18 depicts a bottom view of the third alternate embodiment Child Resistant and Senior Friendly Can Lid with the flexible lid, in accordance with the present invention.

FIG. 18 depicts a bottom view of the bottom surface 60 of the third alternate embodiment of the Child Resistant and Senior Friendly Can Lid 10D illustrating the tab 52 location and the inner edge surface 62 that is relieved 64 on two areas leaving a ridge 66 to the lid sealing ledge 62 maintain the sealing capability when the Child Resistant and Senior Friendly Can Lid 10D is placed or replaced on a conventional can 32.

Figure 19:
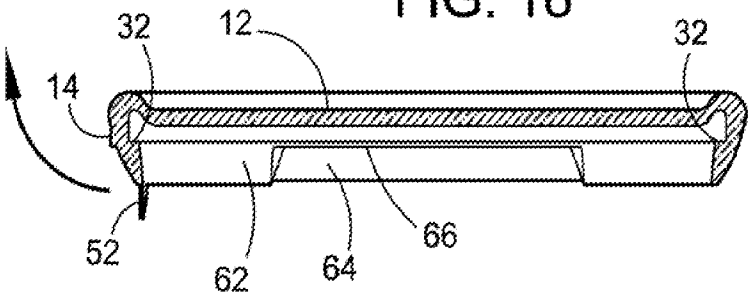
FIG. 19 depicts a cross section of the third alternate embodiment Child Resistant and Senior Friendly Can Lid with the flexible lid, in accordance with the present invention.

FIG. 19 depicts a cross section through the third alternate embodiment of the Child Resistant and Senior Friendly Can Lid 10D further illustrating the tab 52 location, and the inner edge surface 62 is relieved areas 64 on two areas leaving a lid sealing ledge 66. The Child Resistant and Senior Friendly Can Lid 12 can be rotated upward for removal by stretching the material in the relieved areas 64.

Figure 20:
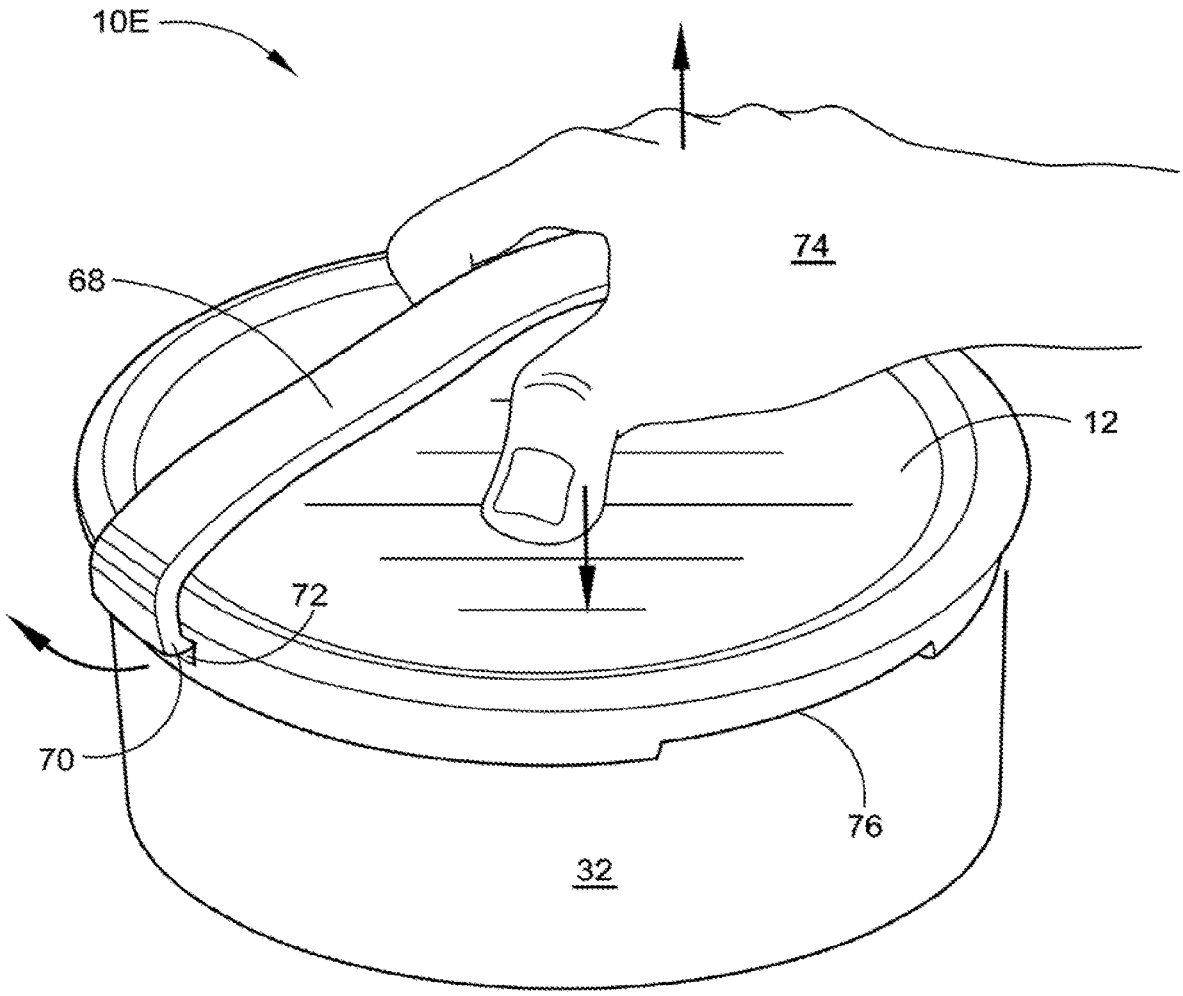
FIG. 20 depicts a perspective view of the fourth alternate embodiment Child Resistant and Senior Friendly Can Lid with a flexible lid and a hand with a strap tool exerting pressure to bend the lid to open the can, in accordance with the present invention.

FIG. 20 depicts in 10E a perspective view of the fourth alternate embodiment Child Resistant and Senior Friendly Can Lid 10E with a flexible lid 12 and a person's hand using a specialized tool for exerting pressure to bend the lid to readily open the can 32.

Figure 21:
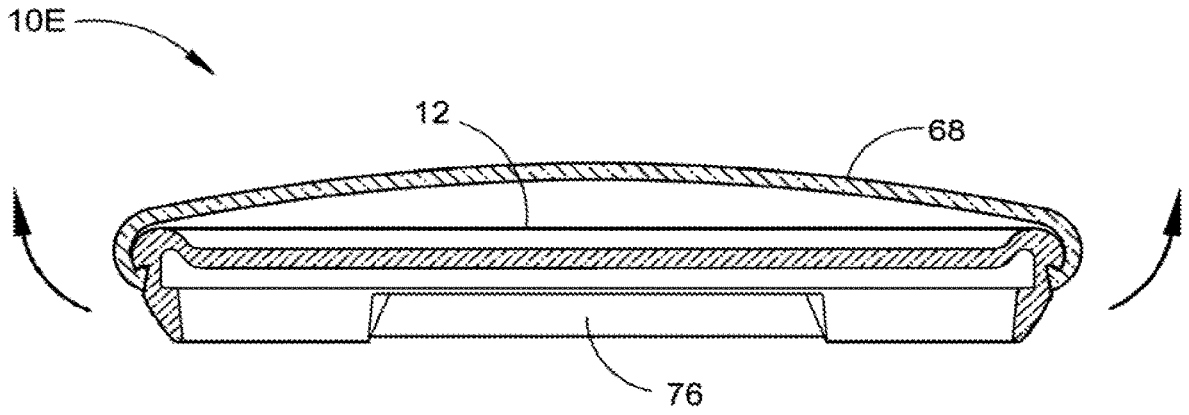
FIG. 21 depicts a cross section of the flexible lid with the opening tool, in accordance with the present invention.

FIG. 21 depicts a cross section through the fourth alternate embodiment of the Child Resistant and Senior Friendly Can Lid 10E where pressure can be exerted to bend the lid 12 at the relieved area 76 to open the conventional can 32.

Figure 22:
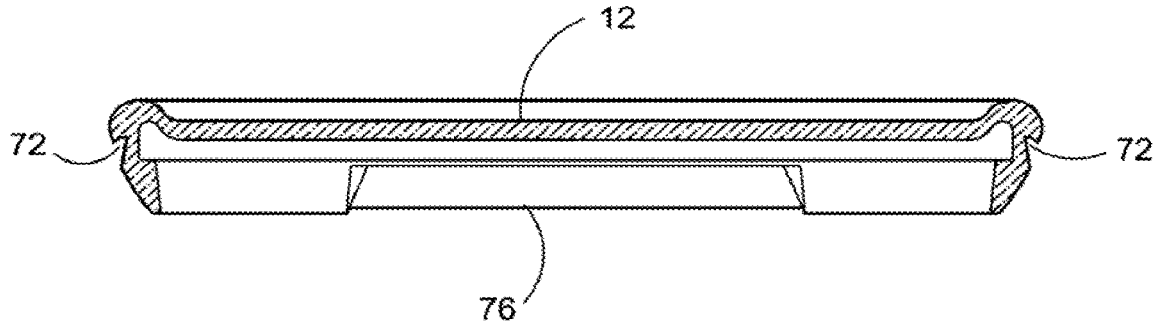
FIG. 22 depicts a cross section of the flexible lid with a thin section to aide in the flexibility of the lid, in accordance with the present invention.

FIG. 22 depicts a cross section through the fourth alternate embodiment of the Child Resistant and Senior Friendly Can Lid 10E further illustrating the location of the apertures 72 and the relived area 76 to aide in the flexibility of the lid 12.

Figure 23:
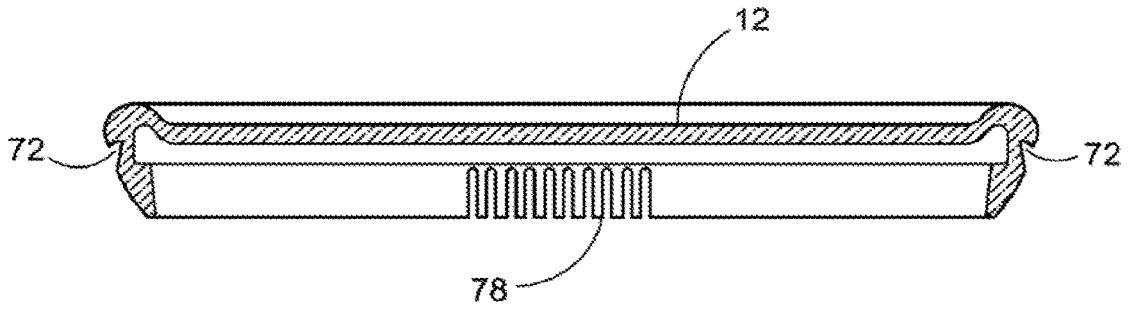
FIG. 23 depicts a cross section of the flexible lid with a slotted section to aide in the flexibility of the lid, in accordance with the present invention.

FIG. 23 depicts a cross section through the fourth alternate embodiment of the Child Resistant and Senior Friendly Can Lid 10E with a plurality of slots 78 one hundred and eighty degrees apart in the relieved area 76 of the lid so it will flex upward to release from the conventional can 32 when pressure is applied.

Figure 24:
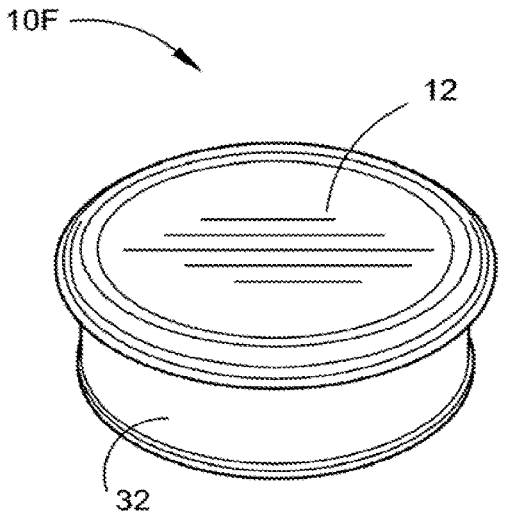
FIG. 24 depicts a perspective view of the fifth alternate embodiment Child Resistant and Senior Friendly Can Lid on a can, in accordance with the present invention.

FIG. 24 depicts in 10F a perspective view of the fifth alternate embodiment Child Resistant and Senior Friendly Can 10F with the lid 12 on a conventional can 32.

Figure 25:
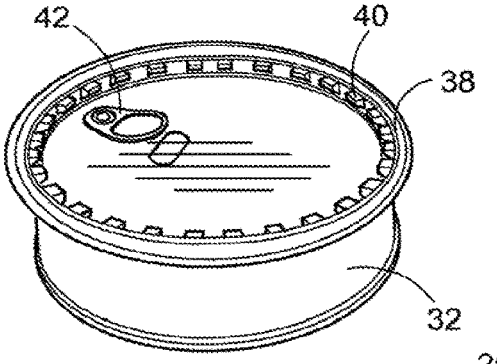
FIG. 25 depicts a perspective view of the top of a conventional can with pop top opener and the securing unit in place, in accordance with the present invention.

FIG. 25 depicts a perspective view of the top of a conventional can 32 with pop-top opener 42 and the securing unit with the tops of the 24 wedge teeth 40 in can locking member 20.

Figure 26:
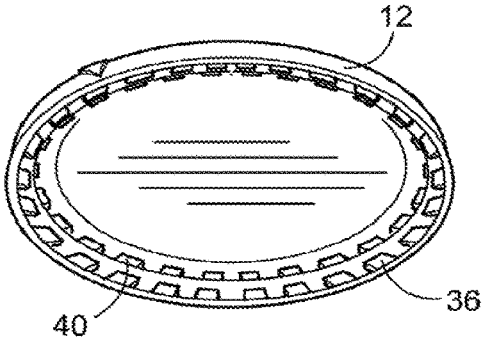
FIG. 26 depicts a bottom view of the assembled Child Resistant and Senior Friendly Can Lid with the securing unit in place, in accordance with the present invention.

FIG. 26 depicts a bottom view of the assembled fifth alternate embodiment of the Child Resistant and Senior Friendly Can Lid 10F with the securing unit 38 illustrating the 24 restraining teeth 36 and the 24 wedge teeth 40.

Figure 27:
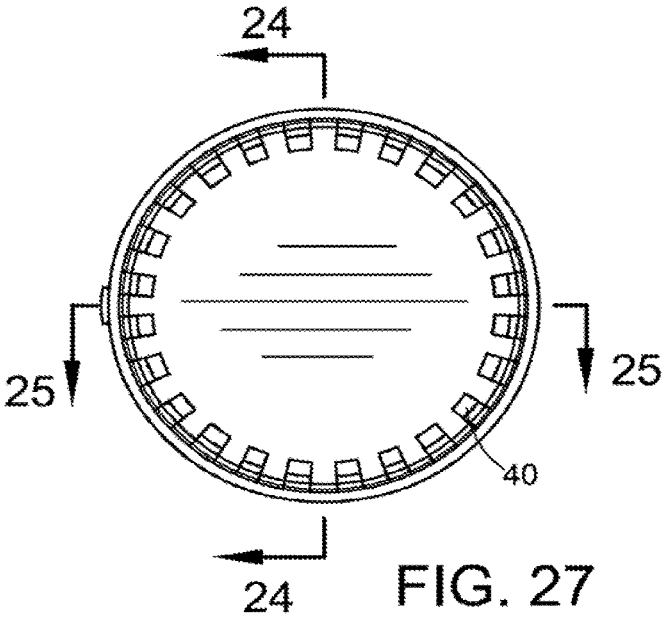
FIG. 27 depicts a bottom view of the Child Resistant and Senior Friendly Can Lid, in accordance with the present invention.

FIG. 27 depicts a bottom view of the fifth alternate embodiment Child Resistant and Senior Friendly Can Lid 10F illustrating the location of the wedge teeth 40.

Figure 28:
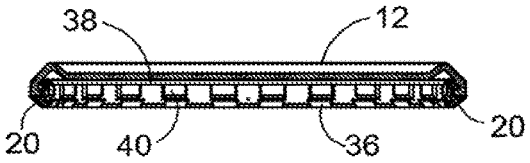
FIG. 28 depicts a cross section of the assembled Child Resistant and Senior Friendly Can Lid, in accordance with the present invention.

FIG. 28 depicts a cross section of the assembled fifth alternate embodiment Child Resistant and Senior Friendly Can Lid 10F lid 12, the can locking member 20 and the restraining teeth 36.

Figure 29:
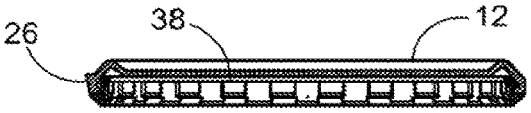
FIG. 29 depicts a cross section of the assembled Child Resistant and Senior Friendly Can Lid illustrating the location of the indicator section on the left side, in accordance with the present invention.

FIG. 29 depicts a cross section of the assembled fifth alternate embodiment Child Resistant and Senior Friendly Can Lid 10F illustrating the location of the indicator section 26 on the left side.

Figure 30:
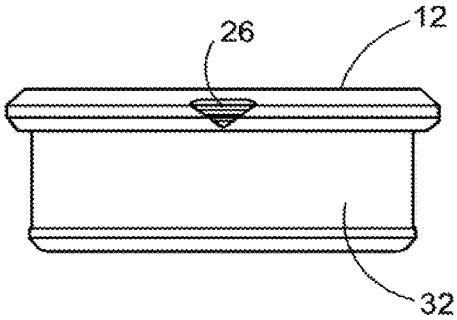
FIG. 30 depicts a side view of a conventional can incorporating the Child Resistant and Senior Friendly Can Lid, in accordance with the present invention.

FIG. 30 depicts a side view of a conventional can 32 incorporating the Child Resistant and Senior Friendly Can Lid 12.

Figure 31:
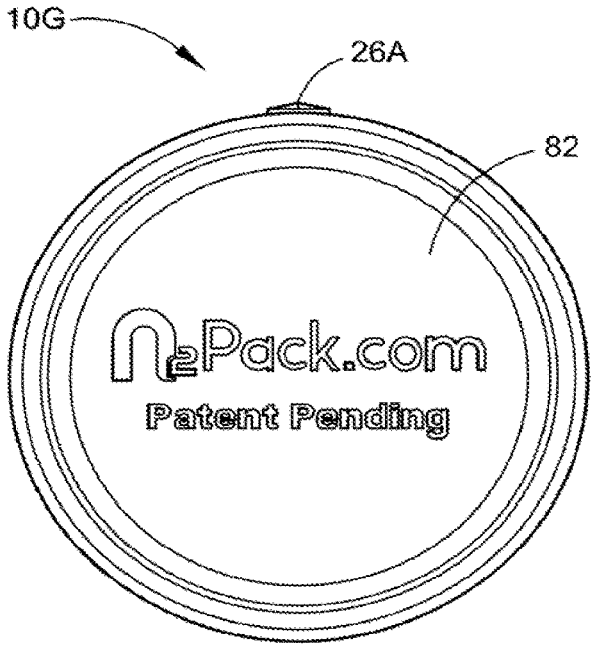
FIG. 31 depicts a top view of the sixth alternate embodiment of the Child Resistant and Senior Friendly Vacuum Sealing Can Lid, in accordance with the present invention.

FIG. 31 depicts a top view of the sixth alternate embodiment Child Resistant and Senior Friendly Can Lid 10G vacuum sealing lid 82.

Figure 32:
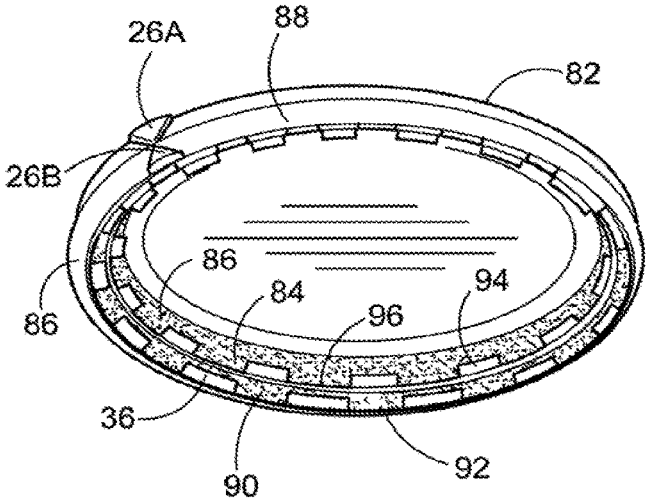
FIG. 32 depicts a perspective view of the underside of the Vacuum Sealing Lid, in accordance with the present invention.

FIG. 32 depicts in 10G a perspective view of the underside of the vacuum sealing lid 82 with the rubber sealant coating 84 applied to the lid inner surface 86, with the vacuum sealing can locking member 88 having the rubber sealant 90 applied on the inner surface of the edge 92. The inner surface of the vacuum sealing can locking member 88 has a plurality of restraining teeth 36 on the lower edge 92 and a plurality of upper supporting teeth 94 on the upper edge 96.

Figure 33:
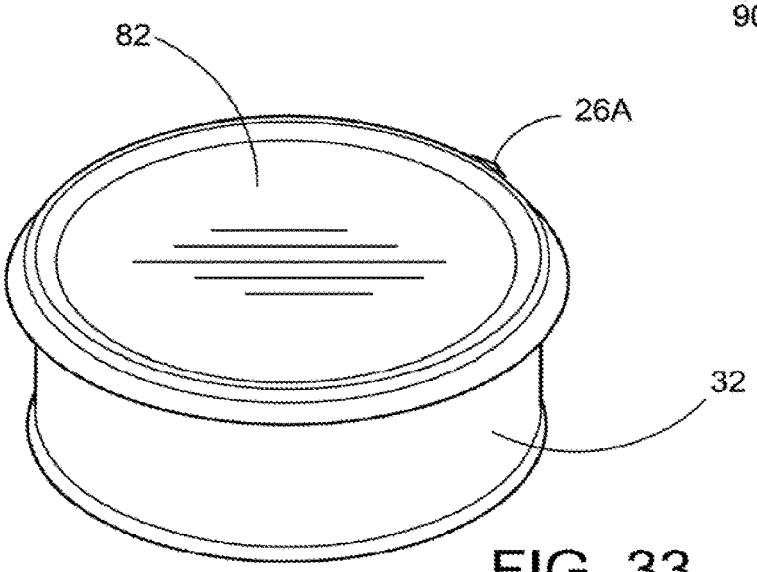
FIG. 33 depicts a perspective view of the top surface of the Vacuum Sealing Lid on the conventional can, in accordance with the present invention.

FIG. 33 depicts a perspective view of the top surface of the vacuum sealing lid 82 on the conventional can 32.

Figure 34:
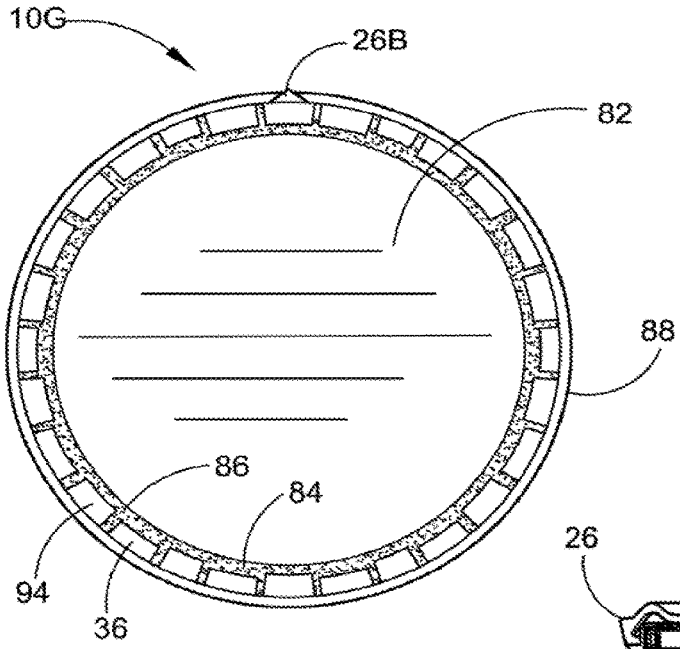
FIG. 34 depicts the underside of the sixth alternate embodiment of the Child Resistant and Senior Friendly Vacuum Sealing Can Lid incorporating the vacuum sealing can locking member, in accordance with the present invention.

FIG. 34 depicts the sixth alternate embodiment Child Resistant and Senior Friendly Can Lid 10G illustrating the underside of the vacuum sealing lid 82 incorporating the vacuum sealing can locking member 88 with the plurality of restraining teeth 36 on the lower edge 92 and a plurality of upper supporting teeth 94 on the upper edge 96. The indicator section 268 is shown on the outer surface at the top of the illustration.

Figure 35:
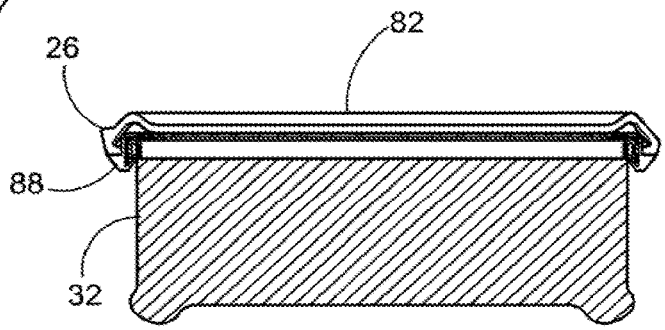
FIG. 35 depicts a cross section of the conventional can with the Vacuum Sealing Lid incorporating the Vacuum sealing can locking member, in accordance with the present invention.

FIG. 35 depicts a cross section of the conventional can 32 with the vacuum sealing lid 82 incorporating the vacuum sealing can locking member 88.

Figure 36:
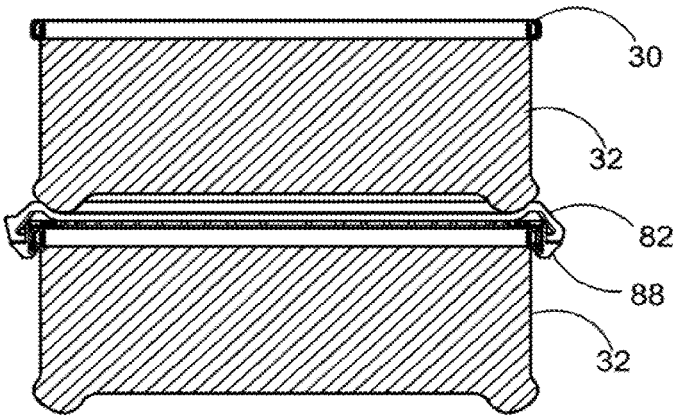
FIG. 36 depicts a cross section of two conventional cans with the Vacuum Sealing Lid on the lower can, in accordance with the present invention.

FIG. 36 depicts a cross section of two conventional cans 32 having a rim 30 with the bottom can 32 having the vacuum sealing lid 82 incorporating the vacuum sealing can locking member 88.

Figure 37:
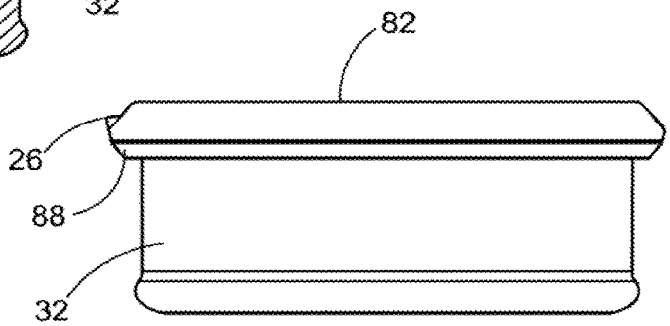
FIG. 37 depicts a side view of a conventional can with the Vacuum Sealing Lid, in accordance with the present invention.

FIG. 37 depicts a side view of a conventional can 32 with the vacuum Sealing lid 82.

Figure 38:
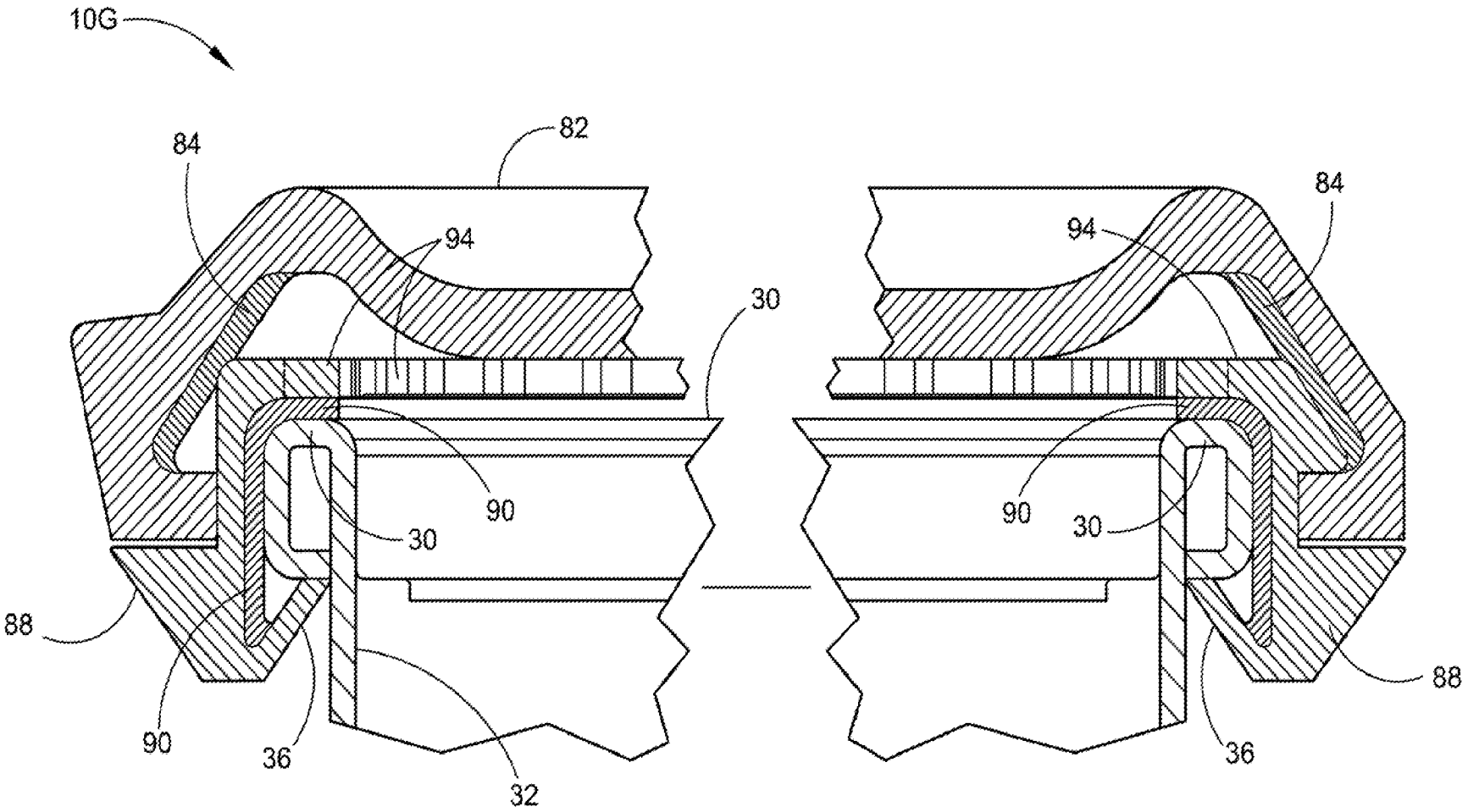
FIG. 38 depicts a cross section of the seventh alternate embodiment Child Resistant and Senior Friendly Can Lid illustrating the Vacuum Sealing Lid having a rubber seal coating and the Vacuum sealing can locking member, in accordance with the present invention.

FIG. 38 depicts a cross section of the sixth alternate embodiment Child Resistant and Senior Friendly Can Lid 10G illustrating the vacuum sealing lid 82 having a rubber seal coating 84 and the vacuum sealing can locking member 88 having a rubber seal coating 90. The rubber seal coating 84 presses against the upper surface of the vacuum sealing can locking member 88 and the rubber seal coating 90 presses against the side surface and top surface of the can rim 30 create the vacuum sealing capability when the vacuum sealing lid 82 is pressed down on the conventional can 32 and the restraining teeth 32 grip the lower edge of the can rim 30.

Figure 39:
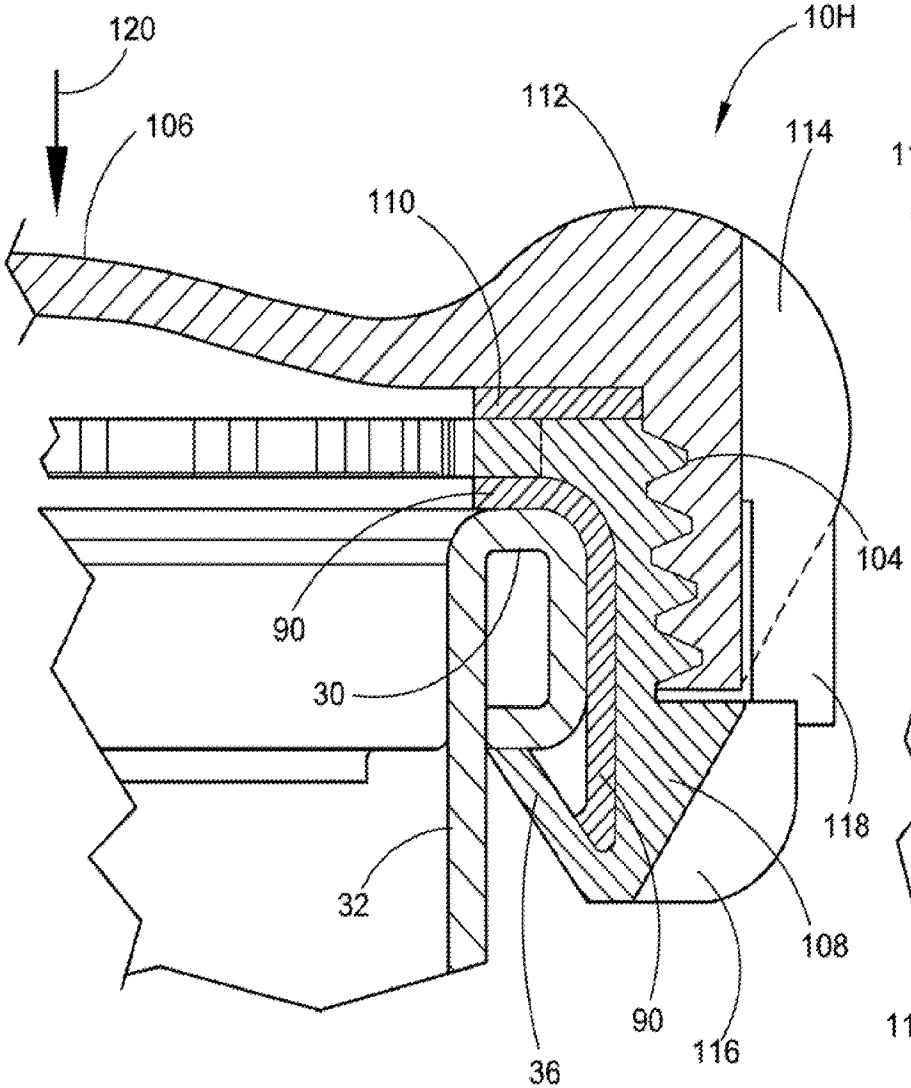
FIG. 39 depicts a cross section of the eighth alternate embodiment Child Resistant and Senior Friendly Child Proof Vacuum Sealing Lid incorporating a threaded attachment to the Vacuum sealing can locking member, in accordance with the present invention.

FIG. 39 depicts a cross section of the seventh alternate embodiment Child Resistant and Senior Friendly Child Proof Can Lid 10H incorporating a threaded attachment 104 between the lid 106 and the vacuum sealing can locking member 108. The vacuum sealing can locking member 108 puts pressure on the rubber sealing coating 90 on the side and top of the can rim 30 when the restraining teeth are locked under the can rim 30. When the lid 106 is tightened down it puts pressure on the rubber sealing coating 110 on the lid 106 and the vacuum sealing can locking member 108.

The lid 106 has a bulbous area 112 on the outer edge with a plurality gripping ribs 114 around the perimeter to aide in tightening down the lid 106. A second set of gripping ribs 116 are on the perimeter of the vacuum sealing can locking member 108. A flexible locking tab 118 is located on one of the gripping ribs 114 to engage with one of the gripping ribs 116 that can be bent upward to release the lid 106 to rotate and open the can 32. By pressing 120 down on the lid 106 a partial vacuum will be achieved within the can 32.

Figure 40:
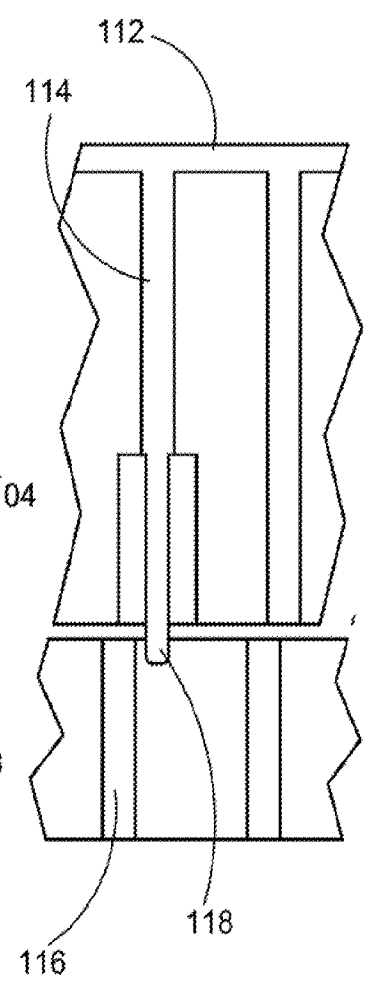
FIG. 40 depicts a partial side view of the eighth alternate embodiment of the Child Resistant and Senior Friendly Child Proof Vacuum Sealing Lid in the locked position, in accordance with the present invention.

FIG. 40 depicts a partial side view of the seventh alternate embodiment Child Resistant and Senior Friendly Child Proof Can Lid 10H illustrating the gripping ribs 114 on the lid 106 and the gripping ribs 116 on the vacuum sealing can locking member 108 with a flexible locking tab 118 straight down in the locked position.

Figure 41:
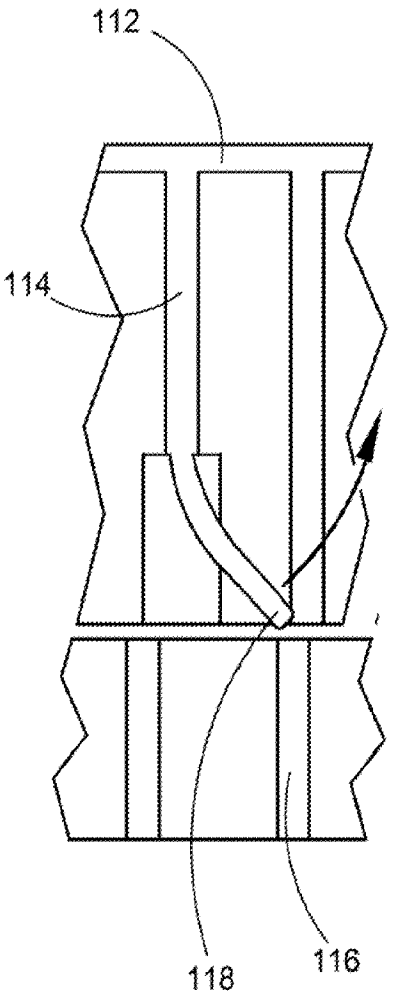
FIG. 41 depicts a partial side view of the eighth alternate embodiment of the Child Resistant and Senior Friendly Child Proof Vacuum Sealing Lid in the unlocked position, in accordance with the present invention.

FIG. 41 depicts a partial side view of the seventh alternate embodiment Child Resistant and Senior Friendly Child Proof Can Lid 10H illustrating the gripping ribs 114 on the lid 106 and the gripping ribs 116 on the vacuum sealing can having a locking member 108 with the flexible locking tab 118 bent up to release the lid 106 to rotate and be removed.

The Child Resistant and Senior Friendly Can Lid 10A, 10B, 10C, 10D, 10E, 10F, 10G and 10H, shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Child Resistant and Senior Friendly Can Lid 10A, 10B, 10C, 10D, 10F, 10G and 10H, in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A two-piece lid assembly, comprising:

a locking member configured to be removably secured to an upper rim of a seal rolled can, wherein the locking member includes— a locking trough disposed about an external circumference of the locking member;

a plurality of teeth disposed about an internal circumference of the locking member, wherein, during operation, the individual teeth are configured to directly engage the upper rim of the seal rolled can; and a first indicator section;

a lid member configured to be engaged with the locking member, wherein the lid member includes— an inner ring sized and shaped to be received within the locking trough when the lid member is engaged with the locking member;

a nib section, wherein, when the lid member is engaged with the locking member, the nib section is positioned to directly engage an externally-facing surface of the locking member; and a second indicator section, wherein, during operation, the lid member is securely affixable to the locking member by aligning the first indicator section with the second indicator section and applying downward pressure on the lid member.

2. The lid assembly of claim 1 wherein the lid member is composed of a material configured to be flexed upward during removal from the locking member.

3. The lid assembly of claim 1 wherein, during operation, when the first and second indicator sections are not aligned, the lid member is not readily removable from the locking member.

4. The lid assembly of claim 1 wherein the locking member further comprises a relief area sized and shaped to allow access to the nib section of the lid member for removal of the lid member when the first and second indicator sections are aligned during operation.

5. The lid assembly of claim 1 wherein the plurality of teeth are evenly spaced about the internal circumference of the locking member.

6. The lid assembly of claim 1 wherein the plurality of teeth comprises 14 to 25 teeth disposed about the internal circumference of the locking member.

7. The lid assembly of claim 1 wherein the plurality of teeth comprises 14 teeth disposed about the internal circumference of the locking member.

8. The lid assembly of claim 1 wherein the first indicator section is aligned with one of the plurality of teeth disposed about the internal circumference of the locking member.

9. The lid assembly of claim 1 wherein the first indicator section and the second indicator section comprise two opposing arrow-shaped indicators.

10. The lid assembly of claim 1 wherein, engaged with the locking member during operation, the lid member is rotatable in both a clockwise and counterclockwise direction.

11. The lid assembly of claim 1 wherein the locking member and the lid member are composed of the same material.

12. The lid assembly of claim 1 wherein the locking member and the lid member are composed of different materials.

13. The lid assembly of claim 1 wherein lid assembly is configured to be openable and resealable multiple times with respect to the seal rolled can.

* * * * *